US007334779B2

(12) United States Patent
Platt

(10) Patent No.: US 7,334,779 B2
(45) **Date of Patent: *Feb. 26, 2008**

(54) CLIP FOR ADJUSTABLE MOUNTING A FENCE RAIL TO A FENCE POST

(76) Inventor: Robert E. Platt, 8701 Highland Ave., Mineral Ridge, OH (US) 44440

( * ) Notice: Subject to any disclaimer, the term of this patent is extended or adjusted under 35 U.S.C. 154(b) by 0 days.

This patent is subject to a terminal disclaimer.

(21) Appl. No.: 11/590,198

(22) Filed: Oct. 31, 2006

(65) Prior Publication Data

US 2007/0045603 A1 Mar. 1, 2007

Related U.S. Application Data

(63) Continuation of application No. 11/191,124, filed on Jul. 27, 2005, now Pat. No. 7,147,212, which is a continuation of application No. 10/246,285, filed on Sep. 18, 2002, now Pat. No. 6,986,505, which is a continuation-in-part of application No. 10/056,719, filed on Jan. 24, 2002, now Pat. No. 6,698,726.

(51) Int. Cl.
*E94H 17/14* (2006.01)
*G01B 3/56* (2006.01)

(52) U.S. Cl. ..... 256/67; 256/69; 33/1 N

(58) Field of Classification Search ..... None
See application file for complete search history.

(56) References Cited

U.S. PATENT DOCUMENTS 432,928 A 7/1890 Bartlett
2,636,273 A 4/1953 Morris
3,589,681 A 6/1971 Ackerman
4,901,444 A 2/1990 Maschmeier
5,189,804 A 3/1993 Ostachowski
5,320,322 A 6/1994 Williams
5,734,356 A 3/1998 Chang
5,788,224 A 8/1998 Platt
6,061,921 A 5/2000 Adams et al.
6,082,019 A 7/2000 Lapp, Jr. et al.
6,314,652 B1 11/2001 English
6,445,361 B2 9/2002 Liu et al.
6,453,568 B1 9/2002 Hymer
6,470,578 B1 10/2002 Phuly et al.

*Primary Examiner*—Daniel P. Stodola
*Assistant Examiner*—Victor MacArthur
(74) *Attorney, Agent, or Firm*—Sand + Sebolt

(57) ABSTRACT

A fence rail clip for attaching a fence rail to a vertical fence post is disclosed. The rail clip has a bracket with a raised central area flanked by two lower lateral areas and a rail connector that, vertically or horizontally, slidingly engages the central area of the bracket. The lateral areas define locations for connecting the bracket to a vertical post. The rail connector has a rail receiving receptacle into which an end of a rail may be inserted. The bracket may include indicia or characters for determining the correct position of attachment of the rail connector to the bracket. When the position of the rail connector is altered by sliding the rail connector relative to the bracket, the angle of the rail receiving receptacle is altered, thereby changing the angle at which a rail may be attached to the post.

8 Claims, 20 Drawing Sheets

FIG-1
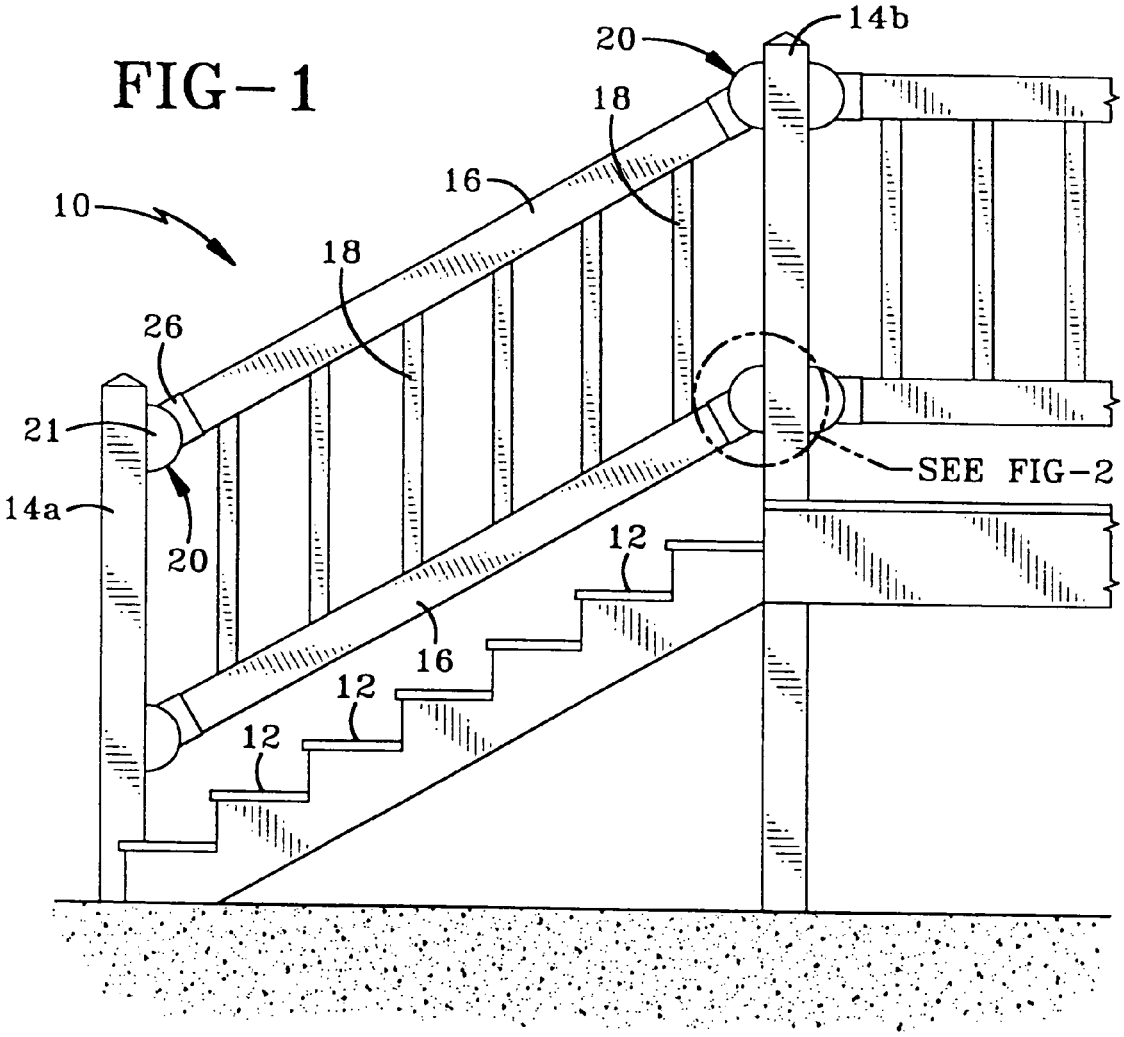
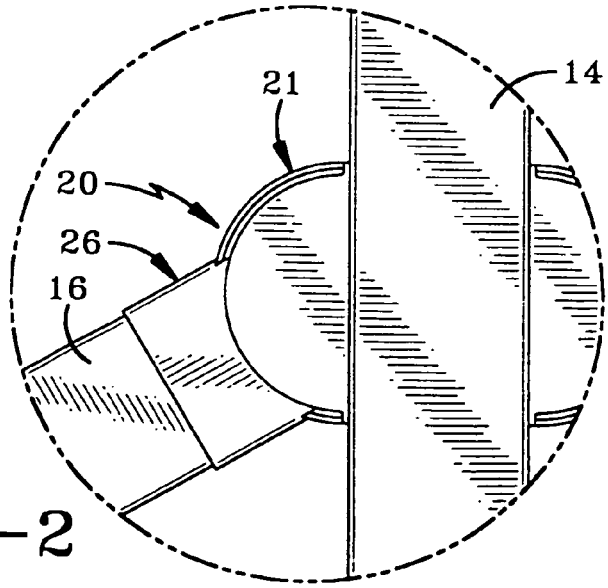
FIG-2

CLIP FOR ADJUSTABLE MOUNTING A FENCE RAIL TO A FENCE POST

This is a Continuation of U.S. patent application Ser. No. 11/191,124, filed Jul. 27, 2005, and now U.S. Pat. No. 7,147,212 which is a continuation of U.S. patent application Ser. No. 10/246,285, filed Sep. 18, 2002 and now U.S. Pat. No. 6,986,505; which is in turn a Continuation-in-Part of U.S. patent application Ser. No. 10/056,719 filed Jan. 24, 2002 and now U.S. Pat. No. 6,698,726; the entire specifications of which are incorporated herein by reference.

BACKGROUND OF THE INVENTION

1. Technical Field

This invention generally relates to clips. More particularly, the invention relates to fence rail clips which fasten fence rails to vertical fence posts. Specifically, the invention relates to a clip with an adjustable bracket that is used to connect a fence post and rail together and allows the installer to preselect the angle that the rail will be held at relative to the post prior to securing the same together.

2. Background Information

It has recently become more common to use either vinyl or plastic products for constructing fences for yards or decks and for railings on deck staircases. While vinyl fencing is aesthetically pleasing and easy to maintain, it poses somewhat of a problem for the contractor who must connect the various components together. It is difficult to connect the fence rails to the vertically extending fence posts. It is even more problematic if the rail must be secured to the post at an angle, as is required during construction of a staircase, or if a fence is being built over undulating terrain.

There is therefore a need for an improved rail clip for attaching horizontal or angled fence rails to vertical fence posts.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

FIG. 1 is a partial side view of a staircase and deck utilizing the present invention;

FIG. 2 is a magnified view of the circled area of the rail clip from FIG. 1;

DETAILED DESCRIPTION OF THE INVENTION

Figure 3:
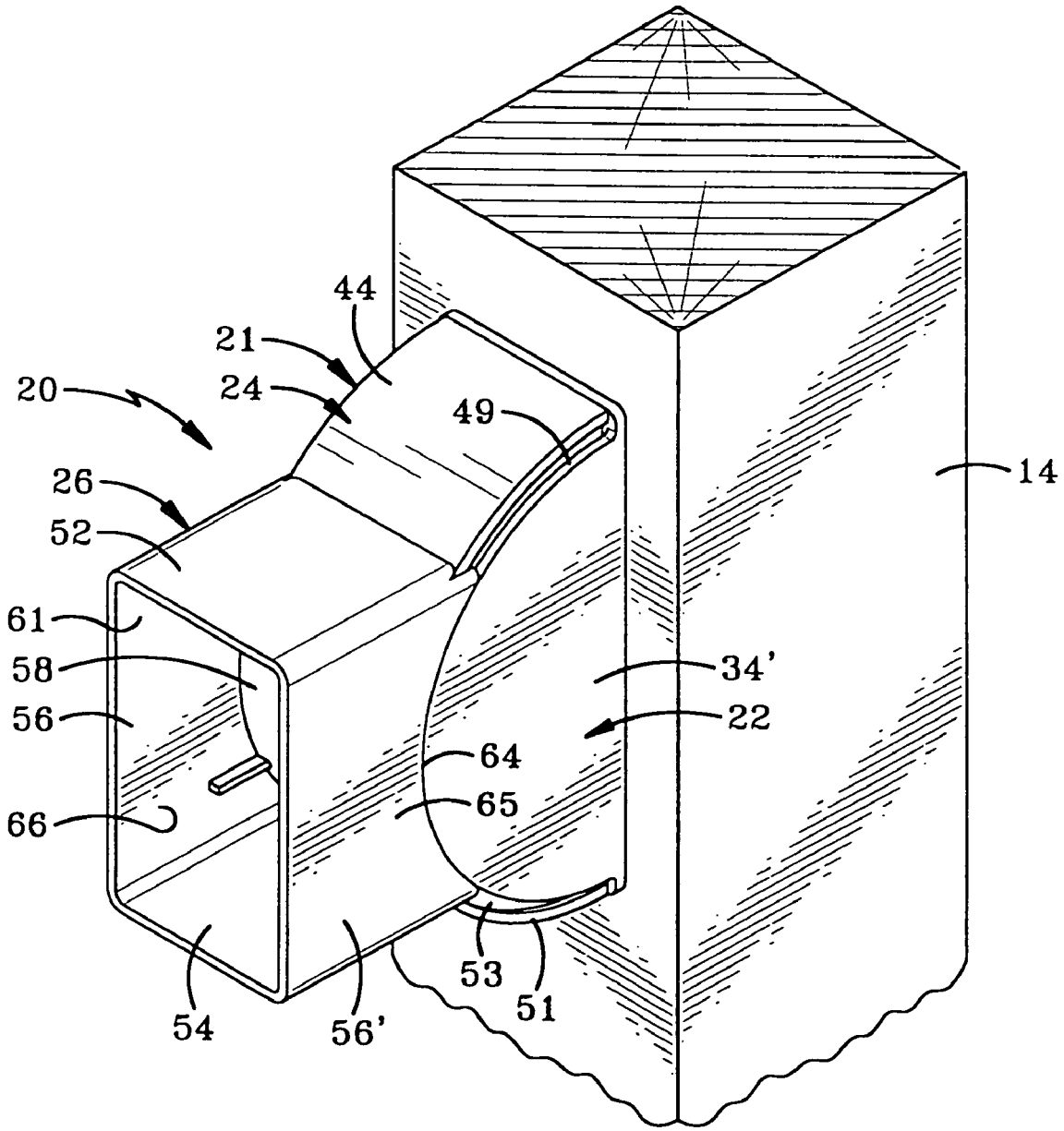
FIG. 3 is a perspective view of the rail clip in accordance with the present invention.

Referring to FIG. 1 there is shown a staircase generally indicated by the numeral 10 that has stairs 12, vertical posts 14, and fence rails 16. Rails 16 are preferably molded from plastic or vinyl and are hollow. Posts 14 may be wooden rectangular shaped posts that extend upwardly from the ground. Rails 16 may be connected to each other by a plurality of cross-beams or balusters 18. Rail clips, generally indicated by the numeral 20, connect rails 16 to posts 14.

Figure 4:
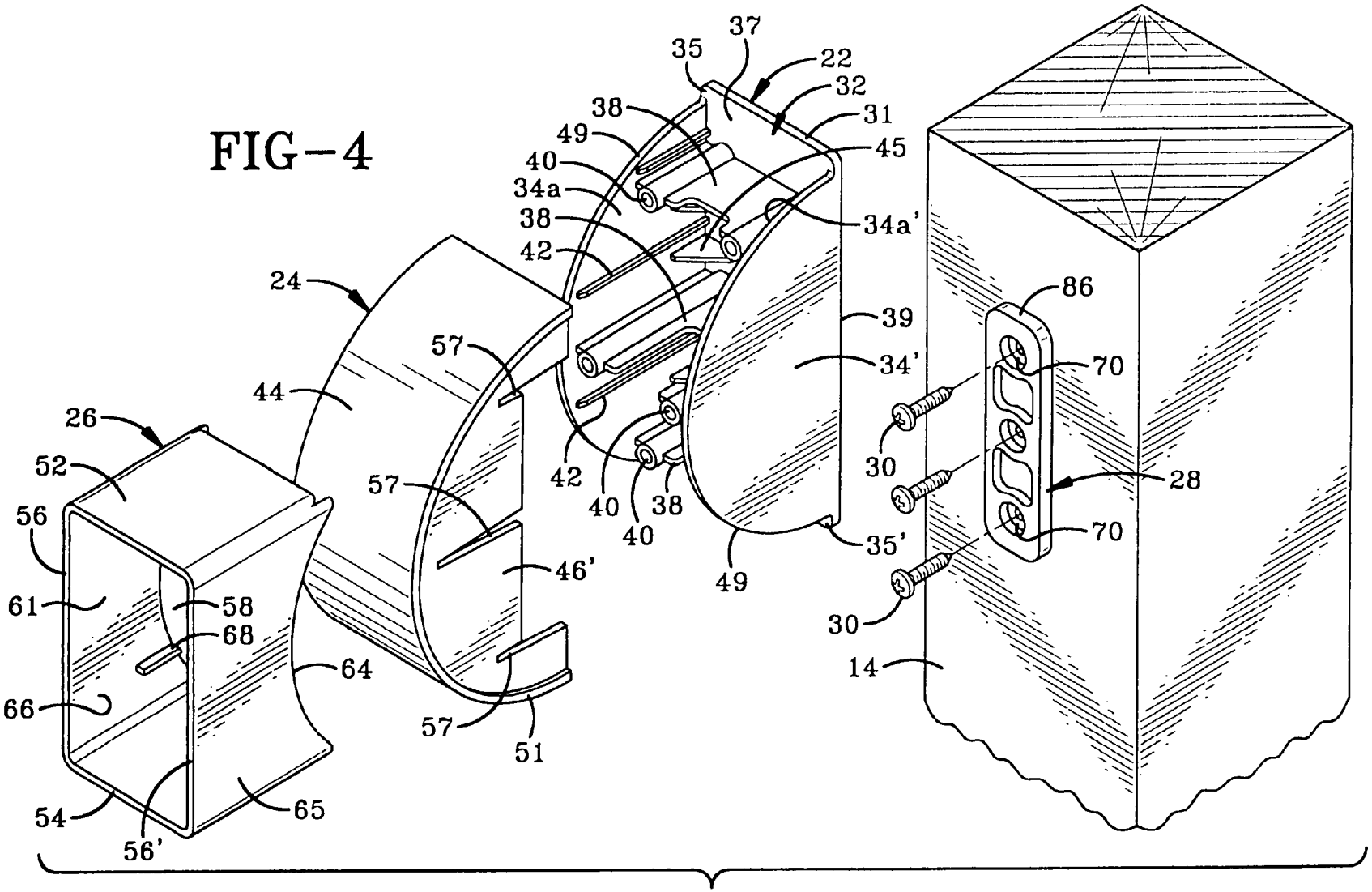
FIG. 4 is an exploded perspective view of the rail clip.
Figure 22:
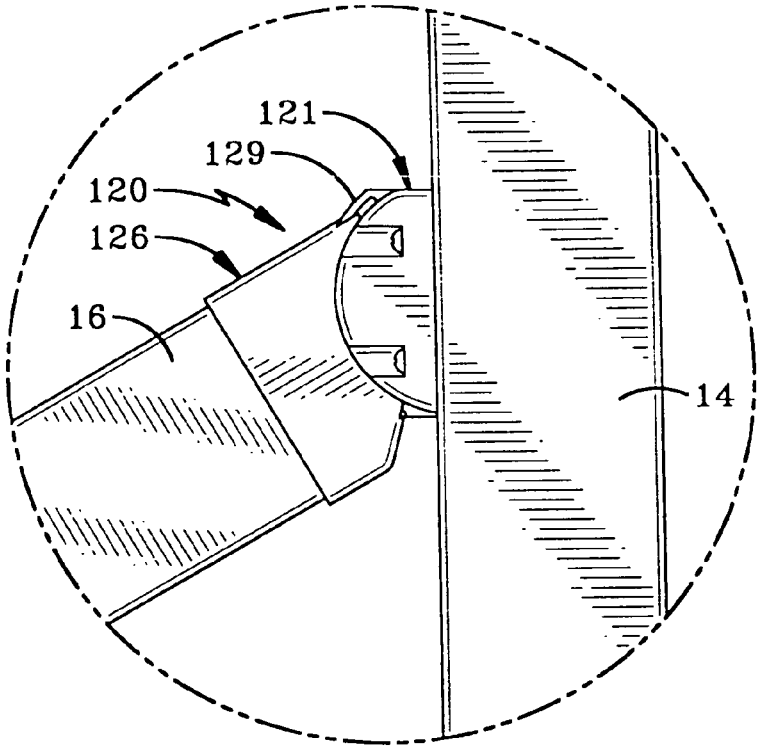
FIG. 22 is a magnified side view of a second embodiment of the rail clip as shown in FIG. 1.

Rail clip 20 is preferably a multi-piece component that is molded of a resilient plastic material. Rail clip 20 may include a base 28, bracket 21 and a rail connector 26. Bracket 21 may be molded as a single unit (FIG. 22—shown as bracket 121) or, as is shown in FIGS. 3-4, may be made up of a housing 22 and cover 24.

Figure 10:
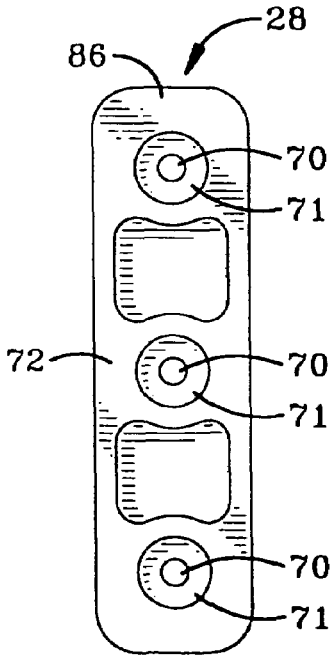
FIG. 10 is a front view of the base.
Figure 11:
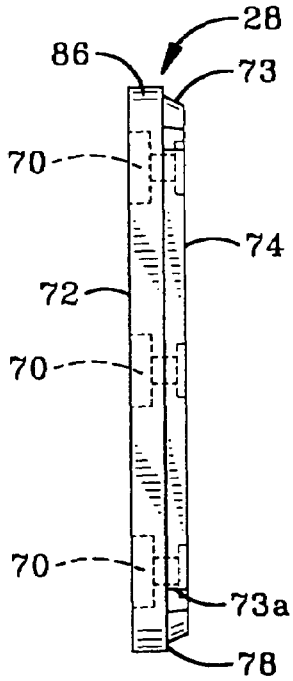
FIG. 11 is a side view of the base.
Figure 12:
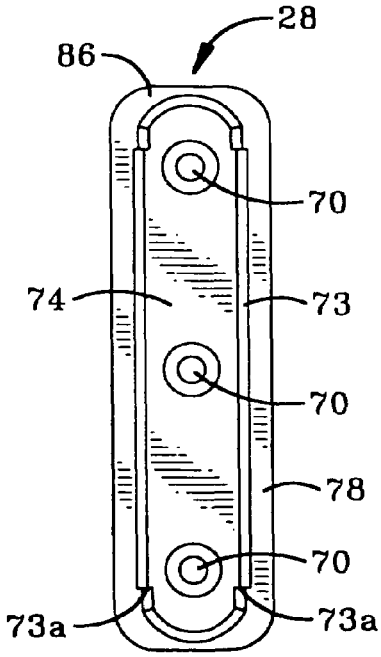
FIG. 12 is a rear view of the base.

Base 28 is preferably rectangular with rounded corners and has a front surface 72 and a rear surface 74 (FIGS. 10-12). A plurality of circular holes 70 are formed through base 28, each hole 70 having an enlarged counterbore formed in front surface 72 and forming a stepped shoulder 71. First screws 30 extend through holes 70 into a pair of holes (not shown) drilled in post 14 and axially aligned with holes 70. A peripheral outer edge 73 of base 28 is tapered inwardly from front surface 72 to rear surface 74 so that rear surface 74 is smaller than front surface 72. A lip 78 is formed in the region where front surface 72 extends beyond rear surface 74. Smaller rear surface 74 abuts post 14 when base 28 is mounted thereon.

Referring to FIGS. 4-7, housing or bracket 22 has a flat, generally U-shaped rear wall 32 and semicircular side surfaces 34, 34'. As seen from FIG. 4, side walls 34, 34' do not extend all the way to the top 31 and bottom 33 of rear wall 32. Ledges 35, 35' are formed between the top 31 and bottom 33 of rear wall 32 and the perimeters 49 of side surfaces 34, 34'. Rear wall 32 has an interior surface 37 and exterior surface 39 and has a pair of spaced-apart legs 41 that form a generally U-shaped slot 36 therebetween. Slot 36 is adapted to slidably receive base 28, the periphery of slot 36 being complementary shaped to engage the tapered outer edge 73 of base 28. Slot 36 is wider proximate bottom 33 of rear wall 32, and then narrows to form guides 76. Slot 36 then narrows further to a generally rectangular shaped area sized to receive and hold base 28. Shoulders 76*a* are provided proximate the upper end of guides 76 to engage with shoulders 73*a* on base 28. When base 28 is engaged in slot 36 the interlocking of shoulders 73*a* and 76*a* prevent withdrawal of base 28 from slot 36.

Figure 18:
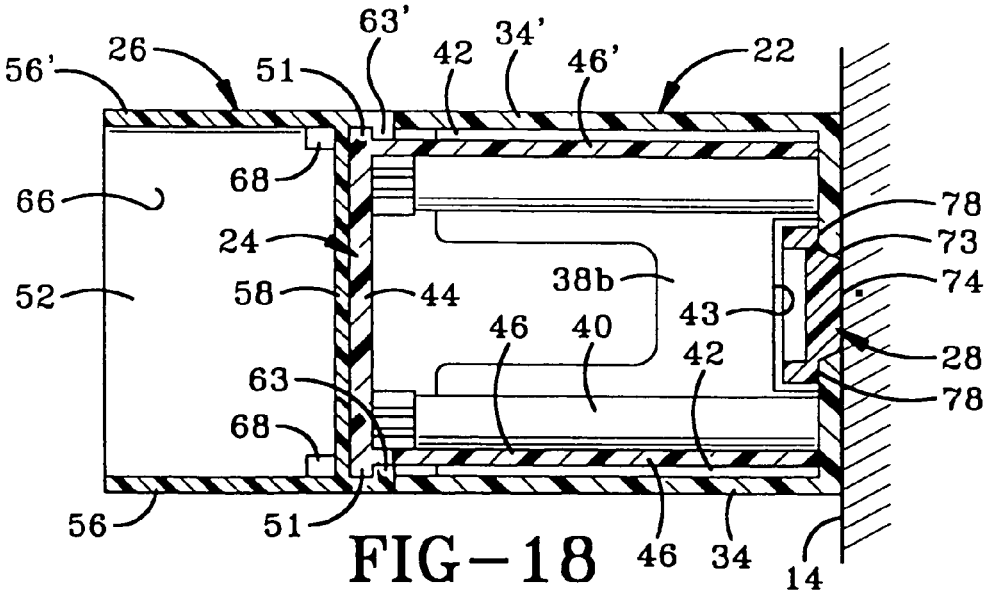
FIG. 18 is a cross-sectional bottom view of the rail clip attached to the post through line 18-18 of FIG. 17.
Figure 19:
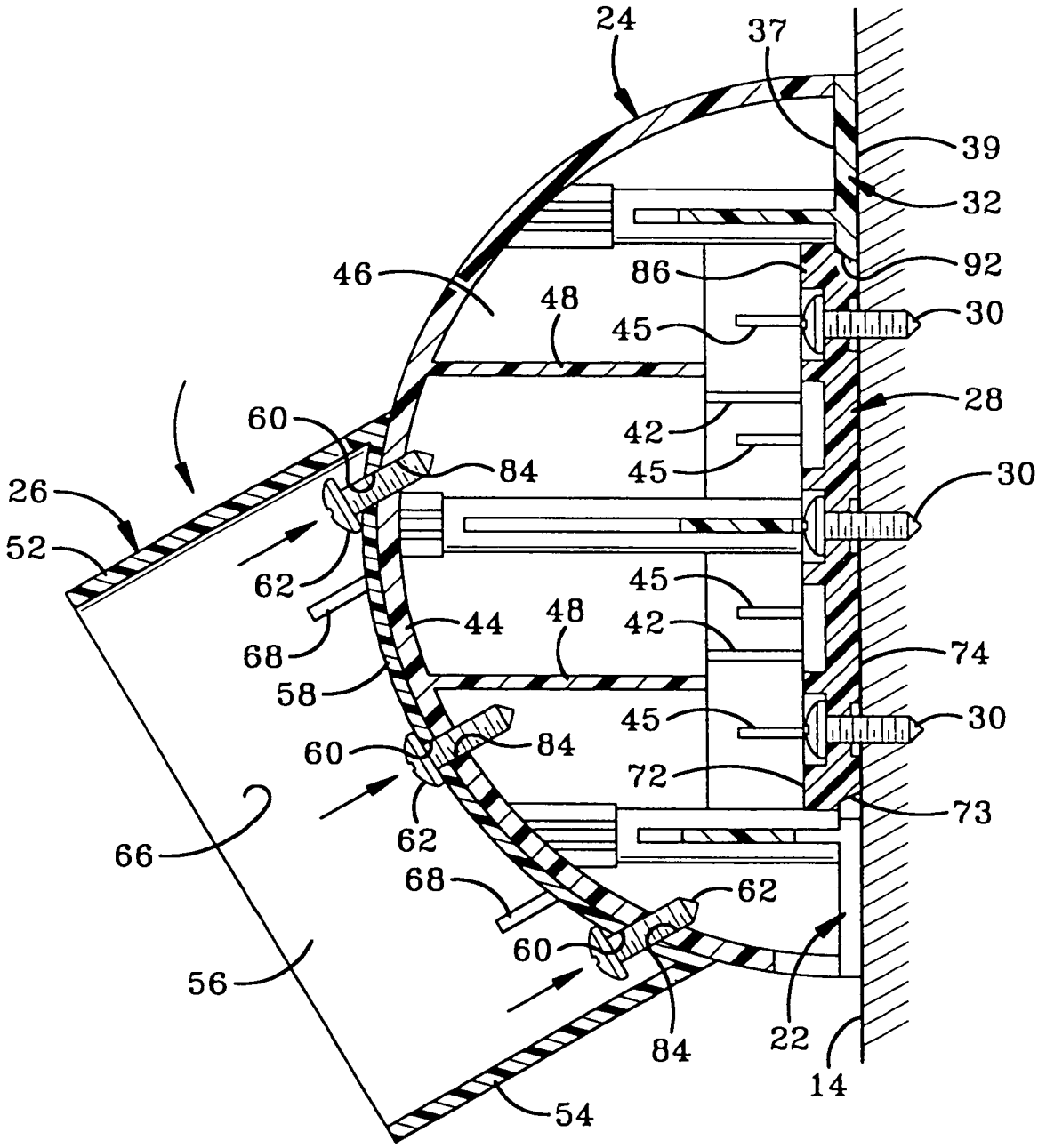
FIG. 19, is a cross-sectional side view of the rail clip attached to the post with the angular connector disposed at an angle to the post.

Housing 22 further includes three connecting walls 38*a*, 38*b*, 38*c* that are disposed at spaced intervals along interior surface 37 of rear wall 32. As seen from FIG. 18, walls 38*b* and 38*c* are generally H-shaped, defining a space 43 through which base 28 may slide. Connecting walls 38*a*, 38*b* and 38*c* connect side walls 34, 34' to each other and to rear wall 32. Connecting walls 38 define a plurality of pin-receiving holes 40. The region of the walls immediately surrounding holes 40 is reinforced. A number of spacers 42 are positioned on the interior surfaces 34*a*, 34'*a* of side walls 34, 34' so that when housing 22 and cover 24 are assembled together a small gap (not shown) exists between interior side surfaces 34*a*, 34'*a* and side walls 46, 46' of cover 24. Additionally, a number of brackets 45 extend between interior surface 37 of rear wall 32 and interior side walls 34*a*, 34'*a*. Brackets 45 are used to strengthen housing 22.

Figure 6:
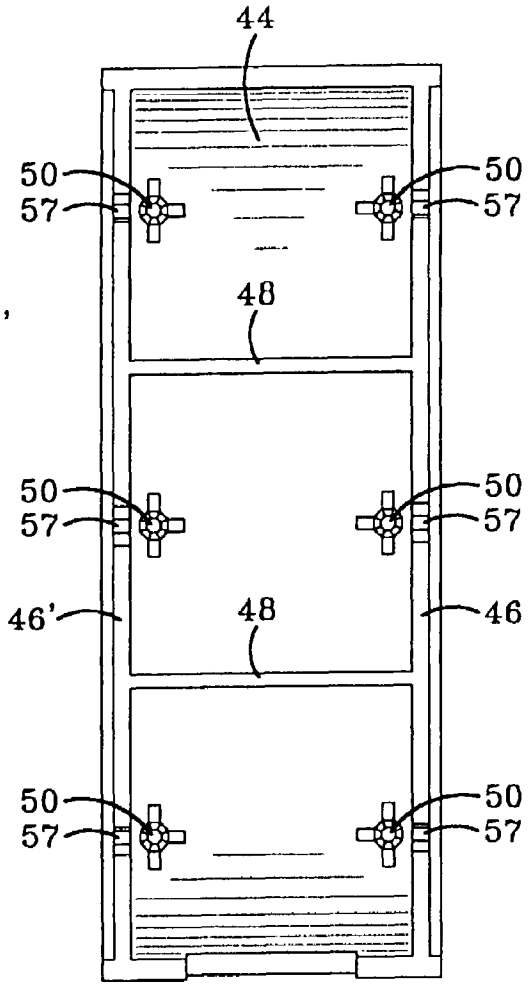
FIG. 6 is a front view of the cover of the rail clip.

Referring to FIGS. 4 and 6, cover 24 has a convexly curved outer wall 44 and two semicircular side walls 46, 46' that preferably extend at right angles from outer wall 44. The diameter of side walls 46, 46' is somewhat greater than the length of rear wall 32 of housing 22. Side walls 46, 46' therefore have a greater radius than that of side walls 34, 34' of housing 22. Additionally, the width of outer wall 44 is slightly less than the distance between interior faces 47, 47' of side wall 46 and side wall 46'. A rim 51 is therefore formed around the circumference of outer wall 44. As a result, when cover 24 and housing 22 are assembled together, a first groove 53 is formed between rim 51 of cover 24 and the perimeter 49 of side surfaces 34, 34'. (If bracket 21 is manufactured as a single unit (not shown) first groove 53 may be formed in the sides of the unit.) A number of connecting walls 48 may be disposed at spaced intervals along outer wall 44. Connecting walls 48 join walls 46, 46' to each other and to outer wall 44. A number of connector pins 50 extend from the interior face 55 of outer wall 44. Pins 50 are disposed a spaced distance apart from each other and the positions of pins 50 correspond to the positions of pin-receiving holes 40 of housing 22. Side walls 46, 46' are partially cut away proximate their mid-section (FIG. 4) and walls 46, 46' define a plurality of slits 57. Slits 57 are positioned adjacent pins 50. When cover 24 engages housing 22, slits 57 receive connecting walls 38*a*, 38*b*, 38*c* of housing 22 therein so that pin-receiving holes 40 are located in the correct position to receive pins 50. When connecting walls 38 are engaged in slits 57 they also assist in keeping housing 22 and cover 24 joined together and aid in preventing relative motion between cover 24 and housing 22.

Inasmuch as the pins 50 are adapted to interlock with pin-receiving holes 40 and the connecting walls 38*a*, 38*b* and 38*c* are adapted to be received into slits 57 and thereby secure housing 22 to cover 24, it will be obvious to those skilled in the art that these components may be manufactured on either of the housing 22 and cover 24, providing the complementary component is located on the other of the housing 22 and cover 24.

Figure 7:
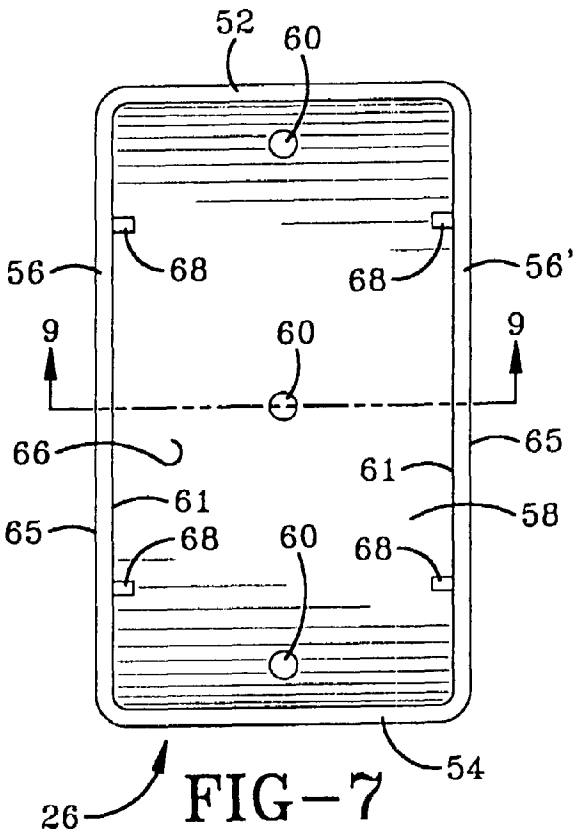
FIG. 7 is a front view of the rail connector of the rail clip.
Figure 9:
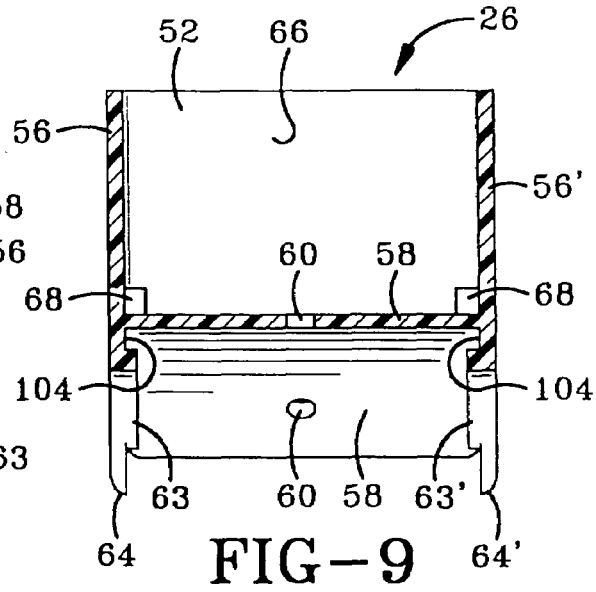
FIG. 9 is a side view of the rail connector through line 9-9 of FIG. 7.

Referring to FIG. 7, rail connector 26 has an upper wall 52, lower wall 54 parallel and spaced apart, side walls 56, 56' and concavely curved rear wall 58. Upper wall 52, lower wall 54 and side walls 56 form a rail receiving receptacle 66 into which an end of rail 16 may be inserted. Rear wall 58 partially projects into the rail receiving receptacle 66. The back edge 64, 64' of side walls 56, 56' is also concave in shape. Both rear wall 58 and side walls 56, 56' are configured so that their curvature is complementary shaped to the curvature of outer wall 44 of cover 24. Rear wall 58 defines a plurality of holes 60 for receiving screws 62 for securing rail connector 26 to cover 24. As seen from FIG. 9, side walls 56, 56' extend a short distance beyond rear wall 58 so that a lip 78 is formed is formed between back edge 64, 64' and rear wall 58. A ridge or boss 63 may be formed proximate back edge 64, 64' of each side wall 56, 56'. Ridge 63 runs along back edge 64, 64'. A second groove 104 is formed between ridge 63 and rear wall 58. While second groove 104 is shown as formed between ridge 63 and rear wall 58, it may be cut into lip 78. Ridge 63 is adapted to engage in first groove 53 and allows rail connector 26 to slide along cover 24. The sliding engagement of rail connector 26 and cover 24 allows the user to position the rail receiving receptacle 66 at any one of a range of positions along outer wall 44 of cover 24. When a rail 16 is received within rail receiving receptacle 66, the rail 16 is disposed at a particular angle relative to bracket 21. As the position of rail connector 26 is changed by sliding it along first groove 53, the angle at which a rail 16 would be held relative to bracket 21 is changed. In this manner, the correct angle for attachment of rail 16 may be obtained. When the appropriate angle is determined by the installer, a drill bit (not shown) is inserted through holes 60. Holes 84 are then drilled into outer wall 44 of cover 24. Second screws 62 are then inserted through holes 60 and 84 to secure rail connector 26 to cover 24. Side walls 56, 56' have an interior face 61 and an exterior face 65 and a plurality of tabs 68 are disposed on interior face 61. Tabs 68 prevent an end 96 of rail 16 from contacting rear wall 58 of rail connector 26. While tabs 68 are shown on side walls 56, 56', they may instead be positioned on interior faces (not shown) of upper wall 52 and/or lower wall 54 or may be positioned on all of the side walls 56, 56', upper wall 52 and lower wall 54.

Rail clip 20 is used in the following manner.

Referring to FIG. 4, when the user wishes to attach rail 16 to post 14, the location of base 28 is marked on post 14. Rear surface 74 of base 28 is then placed against post 14. The position of holes 70 is marked onto post 14 and the installer drills holes (not shown) into post 14 in the marked positions. Base 28 is then repositioned onto post 14 and first screws 30 are inserted through holes 70 and into post 14. Screws 30 are screwed into post 14 until their heads rest on shoulder 71. It is of course possible to secure base 28 to post 14 by other suitable securing means such as nuts and bolts or rivets.

Rail connector 26 is then attached to cover 24 by sliding one of first end 96 or second end 98 of rail connector 26 onto one of first end 100 or second end 102 of cover 24. This is accomplished by inserting rim 51 into the second groove 104. Rail connector 26 is slidingly moved relative to cover 24 until the two components are interlinked together.

The cover/rail connector combination 24/26 is then connected to housing 22 in the following manner. Slits 57 are aligned with connecting walls 38*a*, 38*b* and 38*c*. Cover/rail connector combination 24/26 and housing 22 are then pushed toward each other so that pins 50 engage in pin-receiving holes 40. As the cover/rail connector 24/26 and housing 22 move toward each other, ridge 63 is captured within first groove 53. Cover/rail connector 24/26 and housing 22 are pushed together until pins 50 lock in pin-receiving holes 40.

Figure 5:
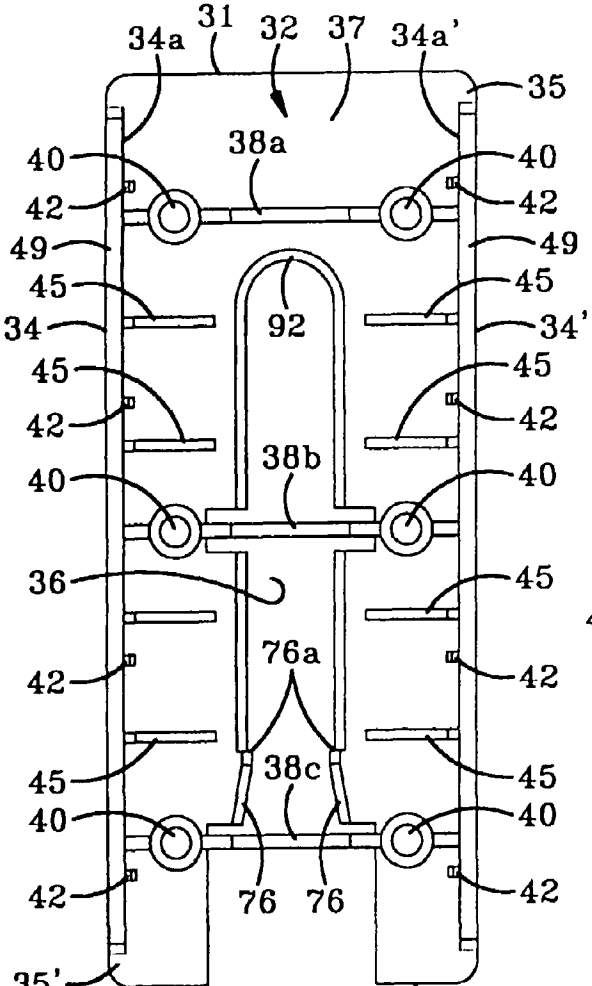
FIG. 5 is a front view of the bracket of the rail clip.
Figure 8:
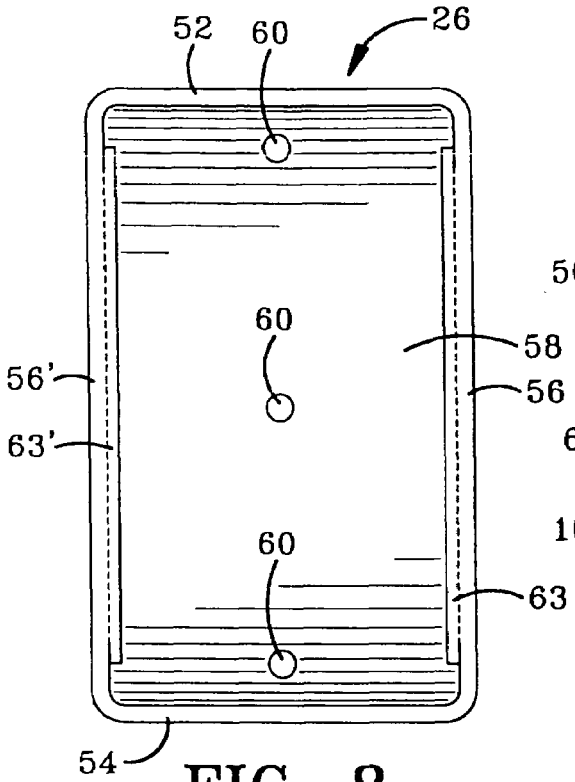
FIG. 8 is a rear view of the rail connector of the rail clip.
Figure 13:
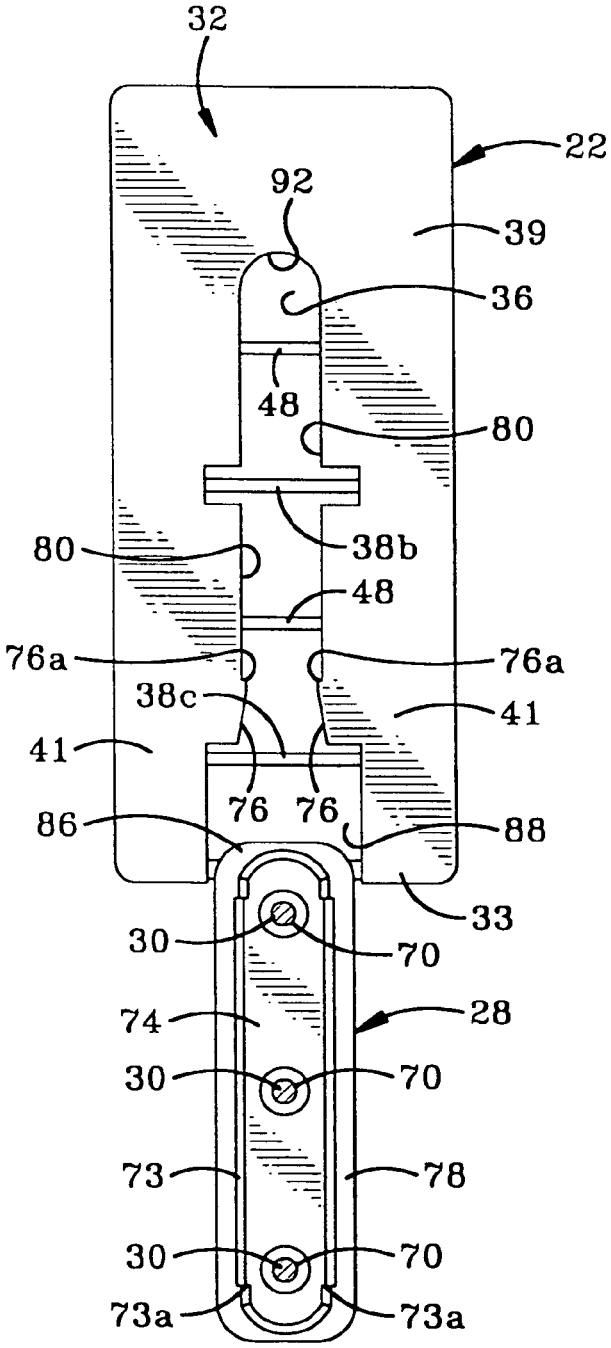
FIG. 13 is a rear view of the bracket beginning to engage the base.
Figure 14:
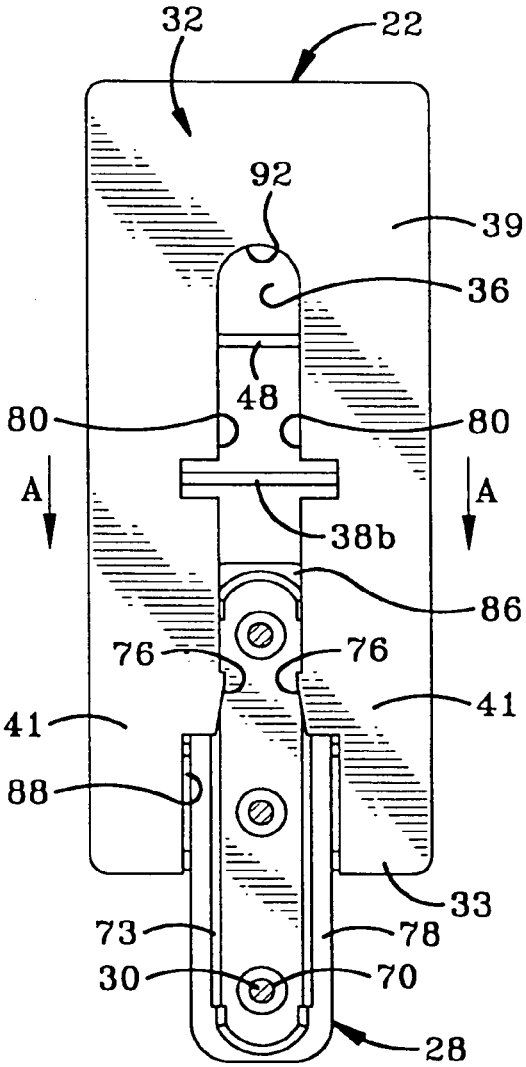
FIG. 14 is a rear view of the bracket partially engaged with the base.
Figure 16:
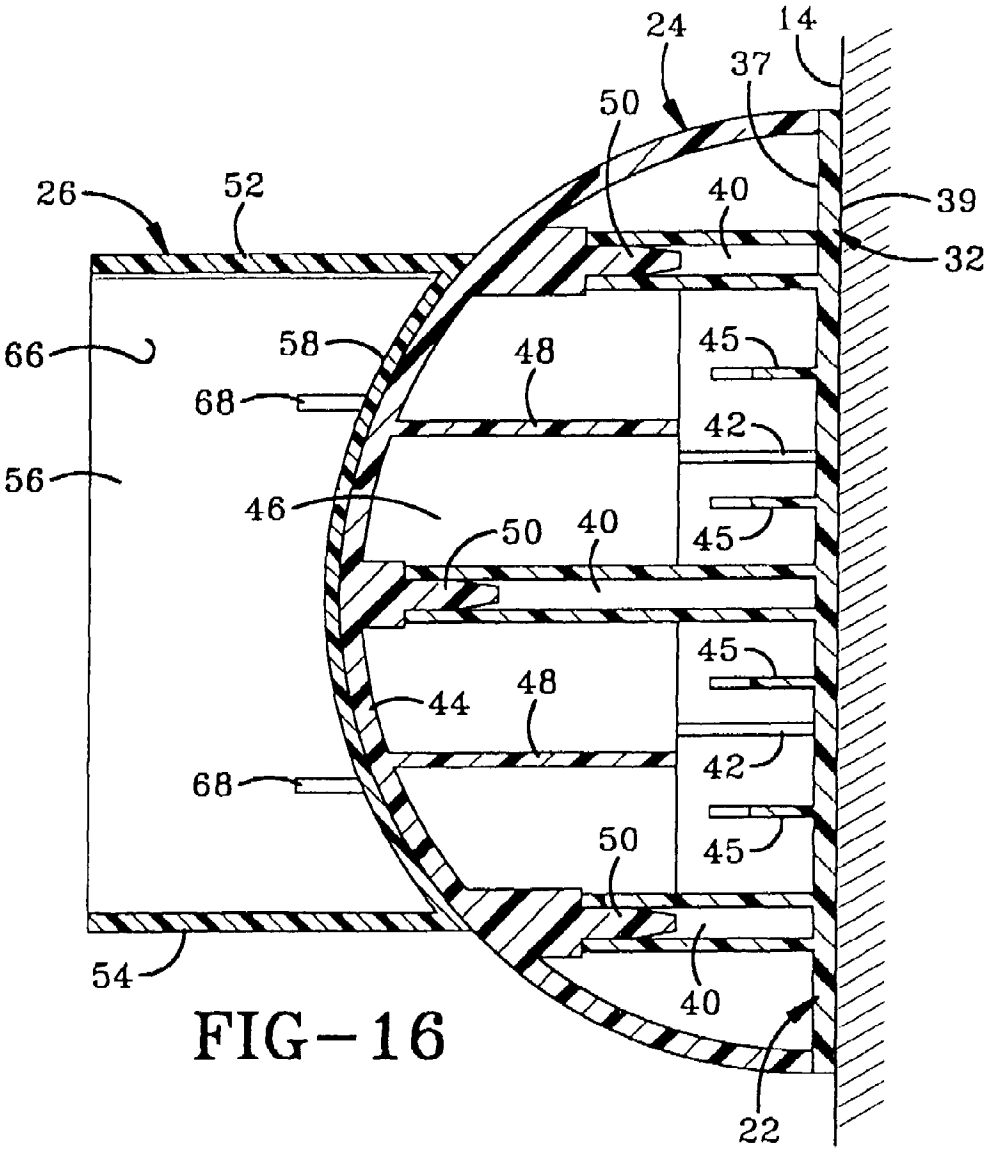
FIG. 16 is a cross-sectional side view of the rail clip positioned against the post.
Figure 15:
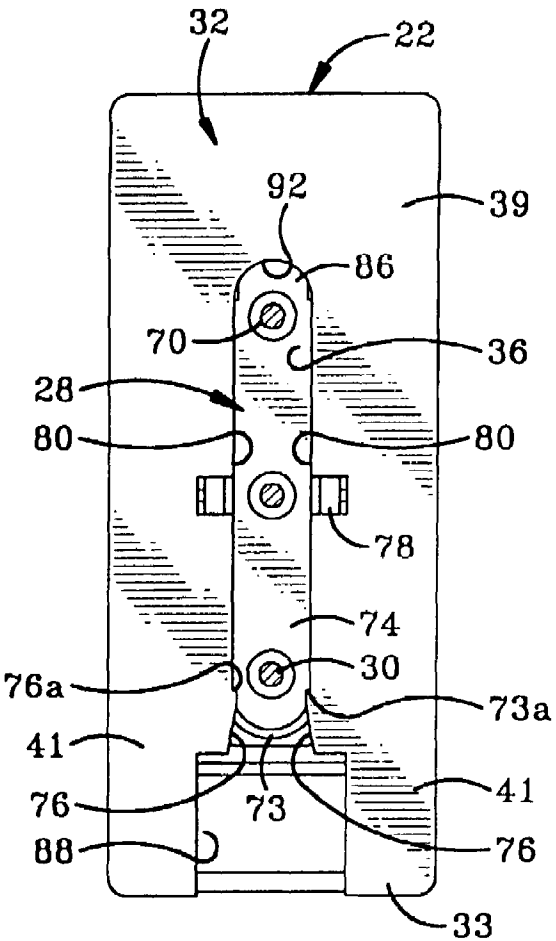
FIG. 15 is a rear view of the bracket fully engaged with the base.
Figure 17:
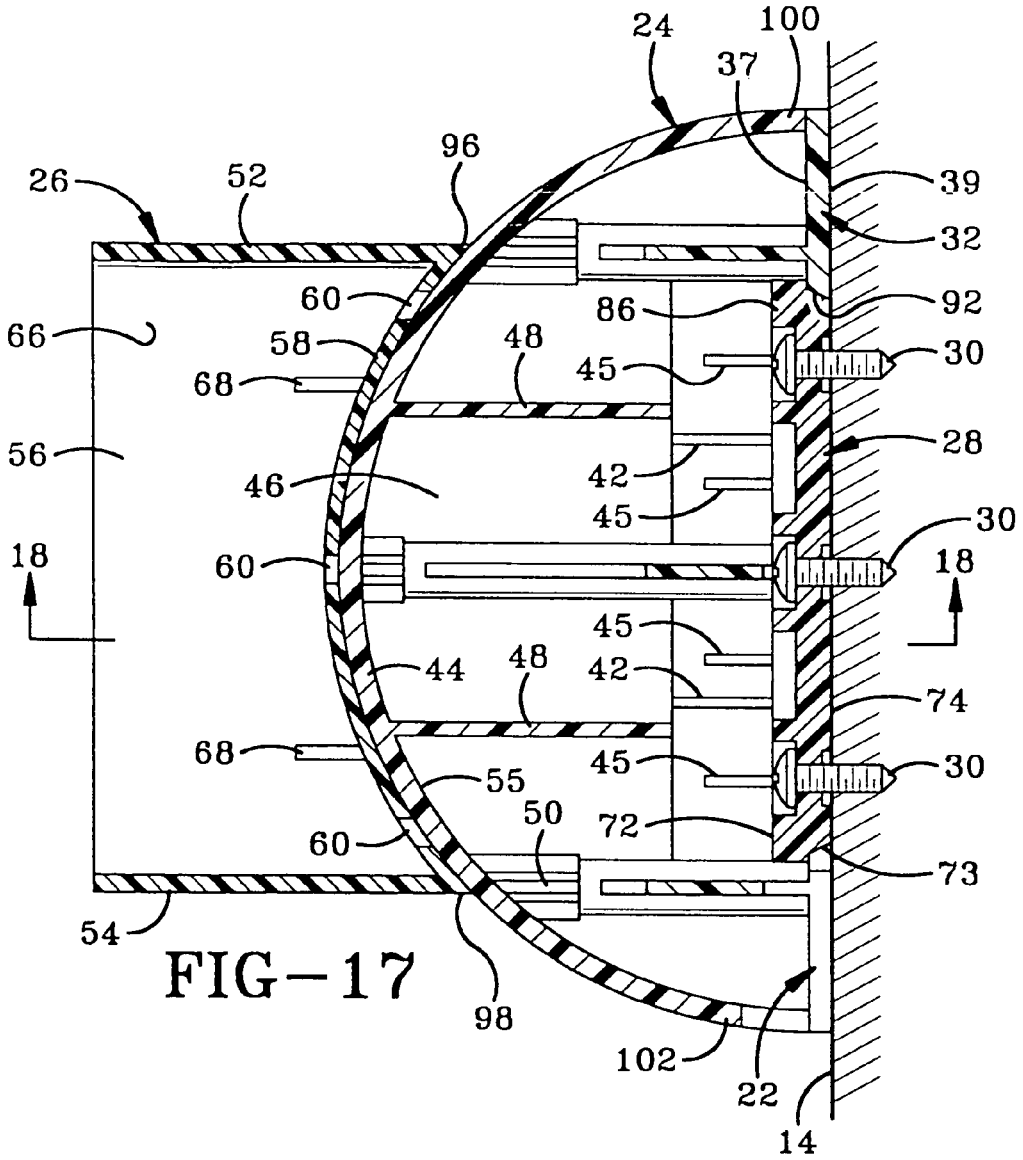
FIG. 17 is a cross-sectional side view of the rail clip attached to the post.

Referring to FIGS. 13-15, bottom end 33 of the housing/cover/rail connector combination 22/24/26 is brought into the vicinity of the top end 86 of base 28. Housing/cover/rail connector 22/24/26 is moved downwardly toward upper end 86 of base and is maneuvered in such a manner that upper end 86 of base enters the widest section 88 of slot 36. As combination 22/24/26 continues to move downwardly in the direction of arrow "A" in FIG. 14, top end 86 of base 28 moves between guides 76 and into the narrower portion of slot 36. In this position, the edges 80 of legs 41 of rear wall 32 slide under lip 78 of base 28. As combination 22/24/26 continues to move downwardly in the direction of "A" until top end 86 of base 28 contacts upper end 92 of slot 36 (FIG. 5). When base 28 is in this position, the housing/cover/rail connector 22/24/26 is securely mounted onto post 14.

As will be obvious to those skilled in the art, it is possible to assemble rail clip 20 in any other manner. For example, base 28 may be secured to post 14, then housing 22 may be connected to base 28. Cover 24 may then be interlocked with rail connector 26 and the combination of cover 24 and rail connector 26 may then be snapped into place over housing 22.

The installer then determines the appropriate angle required for rail 16 relative to post 14. Rail connector 26 is slidably moved relative to cover 24 until the correct position is reached. The installer then marks points to be drilled on outer wall 44 of cover 24 by inserting a marking implement (not shown) through holes 60 in rear wall 58 of rail connector 26. Holes 84 are then drilled into outer wall 44 and second screws 62 are inserted through holes 60 and into holes 84.

Figure 20:
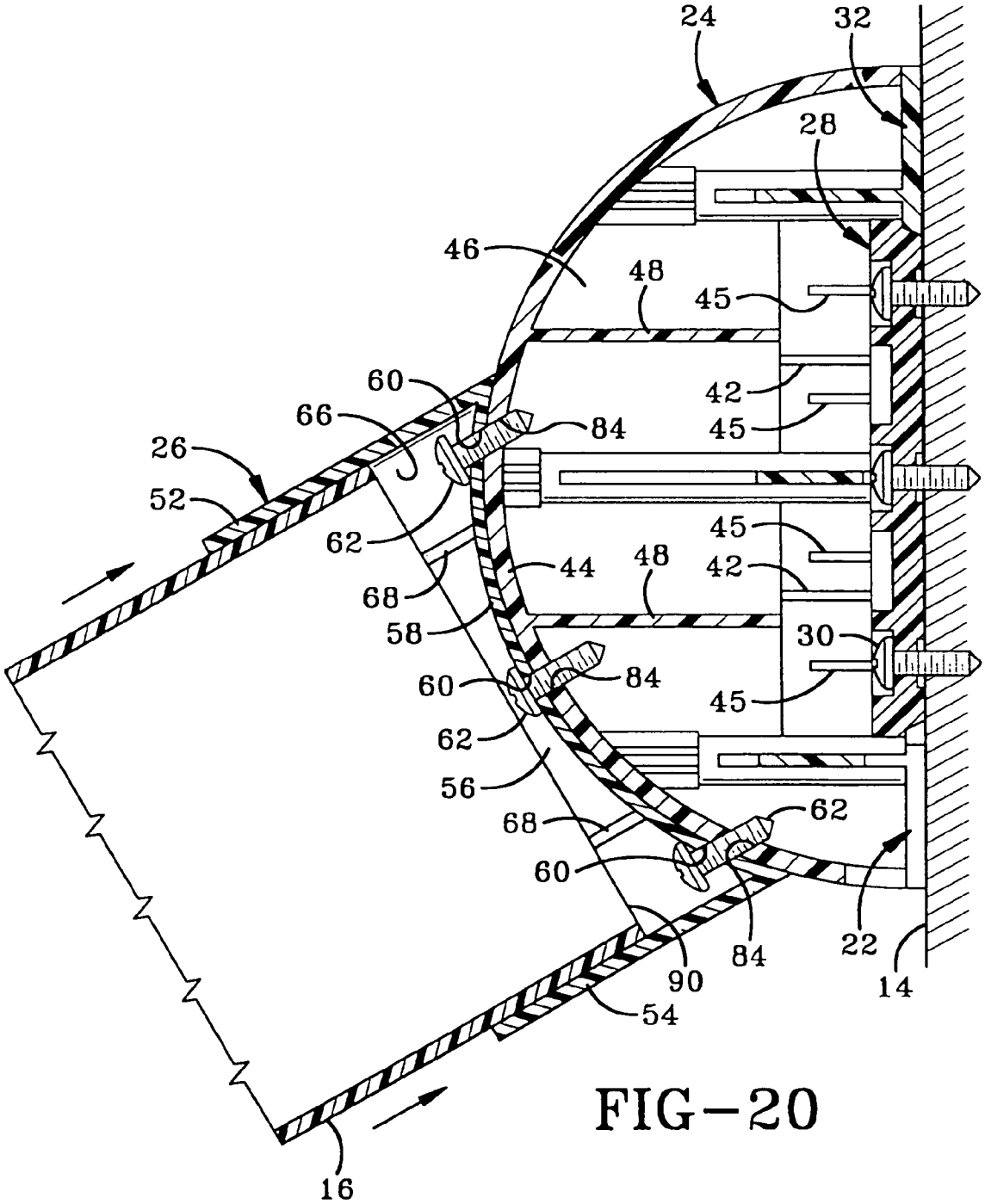
FIG. 20 is a cross-sectional side view of a rail being inserted into the rail connector of the rail clip.

An end 90 of rail 16 may then be inserted into rail receiving receptacle 66 (FIG. 20). End 90 is moved into receptacle 66 until it engages tabs 68.

Figure 21:
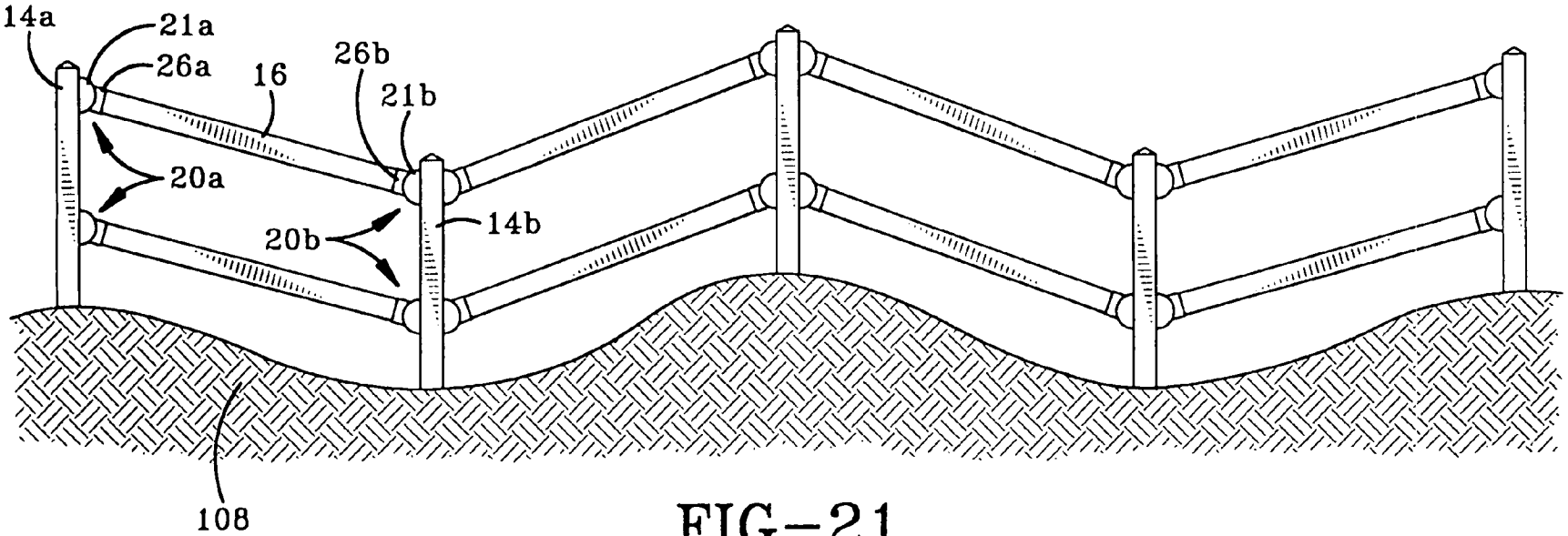
FIG. 21 is a side view of a fence constructed for undulating terrain and utilizing the rail clip of the present invention.

As seen from FIGS. 1 and 21, rail clips 20 may be installed on two adjacent posts 14*a*, 14*b* so that a rail 16 may be installed at the appropriate angle between the two posts 14*a*, 14*b*. The rail clips allow installers to install rails 16 at the correct angle even on fences that are erected on undulating terrain 108.

A second embodiment of the invention is shown in FIGS. 22-31. In this embodiment, the rail clip 120 includes a bracket 121 and a rail connector 126.

Figure 32:
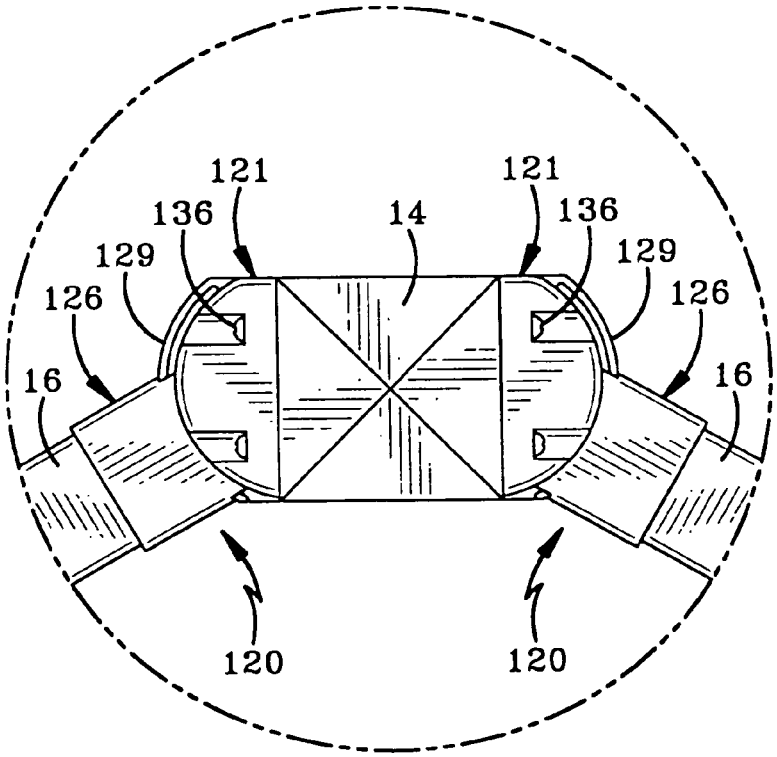
FIG. 32 is a plan view showing two second embodiment rail clips connected to a vertical post, the rail clips being mounted in such a way that the rail connector slides horizontally with respect to the bracket.
Figure 24:
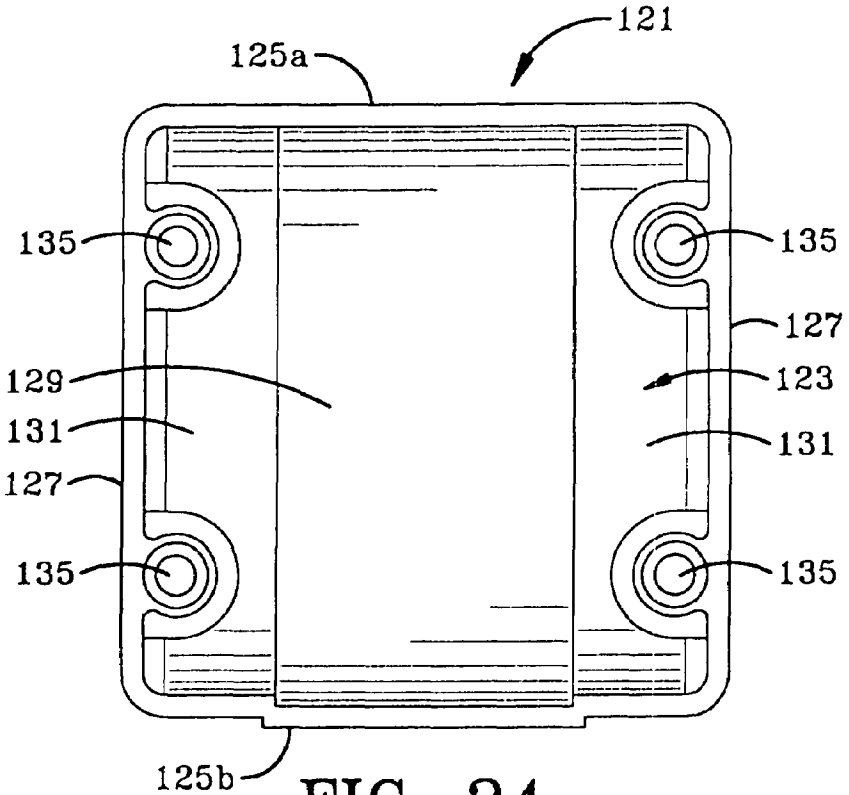
FIG. 24 is a rear view of the cover of FIG. 23.
Figure 23:
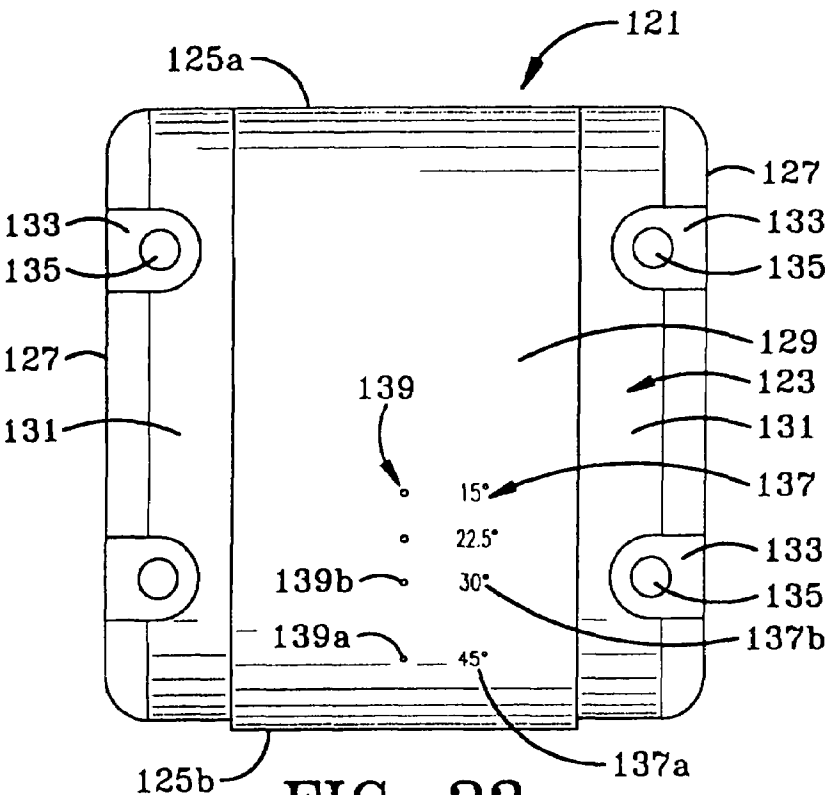
FIG. 23 is a front view of cover of the rail clip shown in FIG. 22.

Referring to FIGS. 22-25, bracket 121 is a single molded piece made from a suitable material such as plastic or vinyl. Bracket 121 may be generally semicircular in shape when viewed from the side. Bracket 121 has an outer wall 123, a top wall 125*a*, a bottom wall 125*b* and side walls 127. Outer wall 123 includes a raised central area 129 disposed between two lower lateral areas 131. Lateral areas 131 define a plurality of slots 133 and apertures 135 through which screws 136 (FIG. 32) may be inserted to secure bracket 121 to a vertical post 14. Lateral areas 131 are provided to allow for easy access to screws 136. Rail connector 126 is received onto raised central area 129 and consequently slots 133 and apertures 135 lay outside of rail connector 126 on lateral areas 131. The positioning of slots 133 and apertures on the lateral area 131 on either side of rail connector 126 makes it easy to install rail clip 120 onto a vertical post 14 or to easily remove the same. It also makes it easy to install rail clip 120 either vertically or horizontally.

A plurality of characters or markings 137, 139 is preferably applied onto or molded into outer wall 123 to aid in the installation of rail clip 120. The characters may however be applied to any other suitable surface of the device. These characters may be numbers, symbols, colors or any other suitable markings and they are preferably marked onto raised central area 129. For example, a plurality of first characters 137 (such as numbers) may be applied to outer wall 123 to indicate the angle at which a fence rail 16 may be held by rail connector 126 relative to bracket 121. Outer wall 123 may further include a plurality of second characters 139 (such as dimples or holes) for accurate placement of the tip of a drill bit (not shown). Second characters 139 may be positioned so as to correspond with first characters 137, e.g., dimple 139*a* would correspond to character 137*a*, dimple 139*b* would correspond to first character 137*b* to ensure correct placement of a screw 143 to secure rail connector 126 to bracket 121. If an installer desires to attach a rail 16 at the angle shown by first character 137*a*, he would drill through the bracket 121 at the position marked by dimple 139*a*. While the preferred embodiment of this invention uses a dimple molded into the outer wall 123 of bracket 121 to mark the spot for drilling, any other suitable marking may be used, e.g., an "X" applied to the outer surface in a suitable dye, or the use of a raised bump. Similarly, other suitable markings may be used to indicate angles at which a rail receiving receptacle 166 may be held relative to bracket 121, e.g., bands of color with an explanatory key may be provided with the rail clip's instructions. Other ways of marking the bracket 121 or rail connector 126 may be used without departing from the scope or intent of the present invention.

Figure 31:
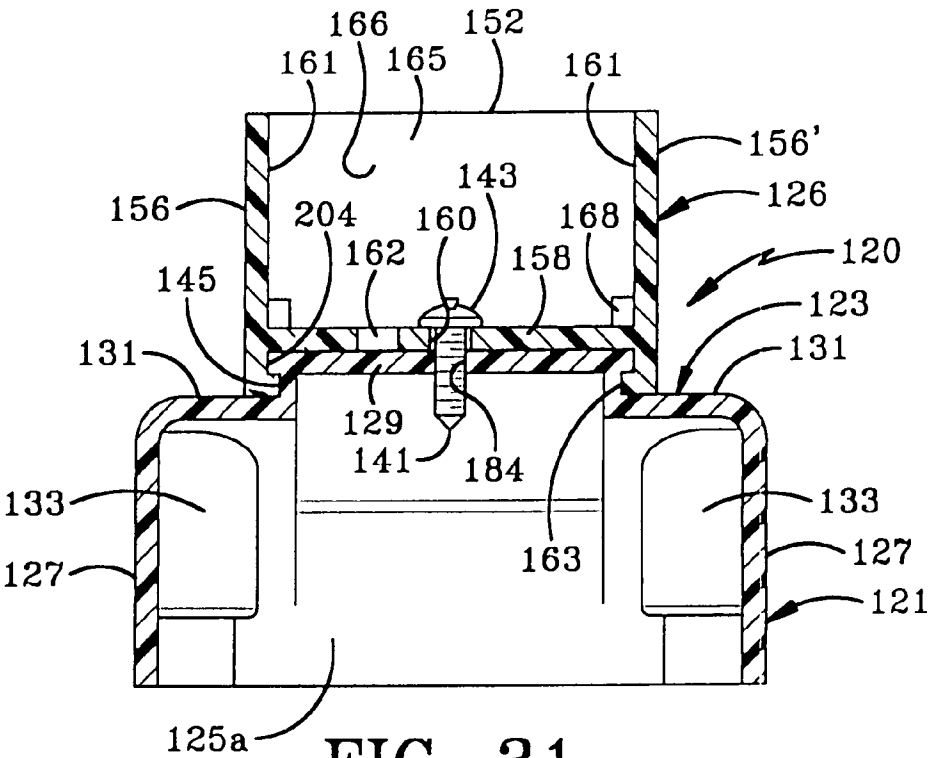
FIG. 31 is a cross-sectional top view of the rail clip of FIG. 22 showing the rail connector secured to the cover.
Figure 25:
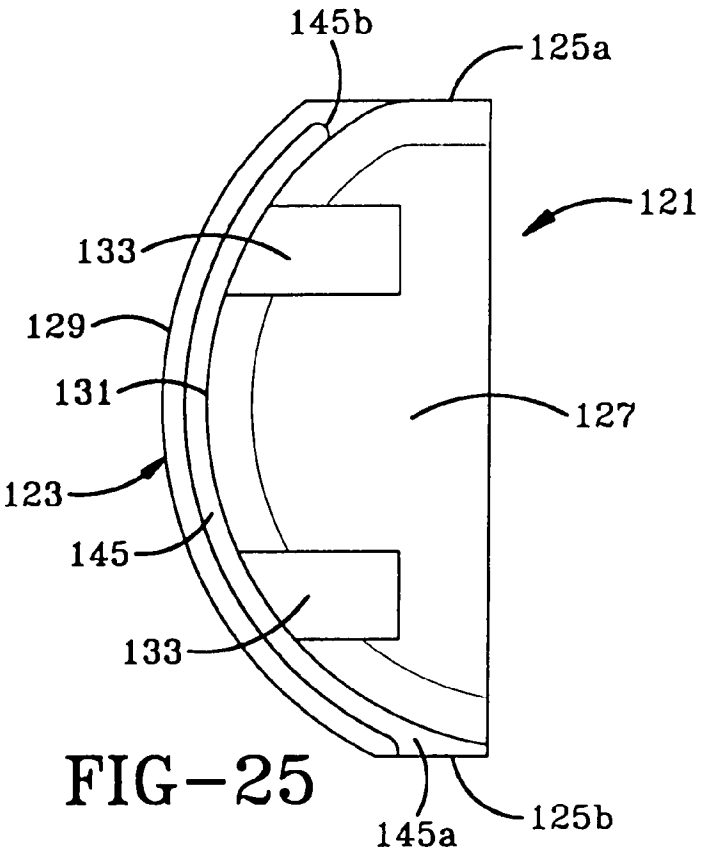
FIG. 25 is a side view of the cover of FIG. 23.

As seen from FIGS. 25 and 31, raised central area 129 further defines a pair of lateral grooves 145. Grooves 145 may be open at least at a first end 145*a* to allow for engagement with rail connector 126. Grooves 145 may, alternatively, be closed at a second end 145*b*, to prevent rail connector 126 from sliding off bracket 121 or to limit the sliding motion of rail connector 126 relative to bracket 121. Grooves 145 may be aligned either vertically or horizontally, thereby allowing for rail connector 126 to be moved relative to bracket 121 through either a vertically oriented arc or a horizontally oriented arc.

Figure 28:
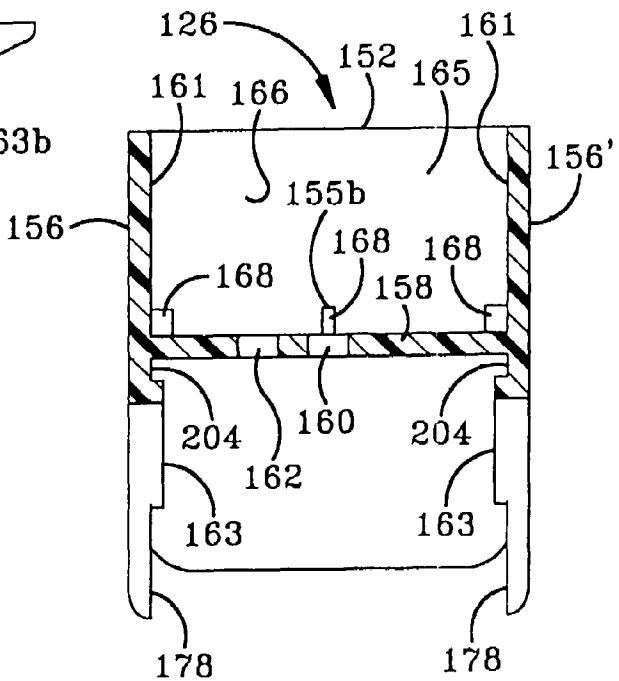
FIG. 28 is a partial cross-sectional top view of the rail connector of FIG. 26.
Figure 27:
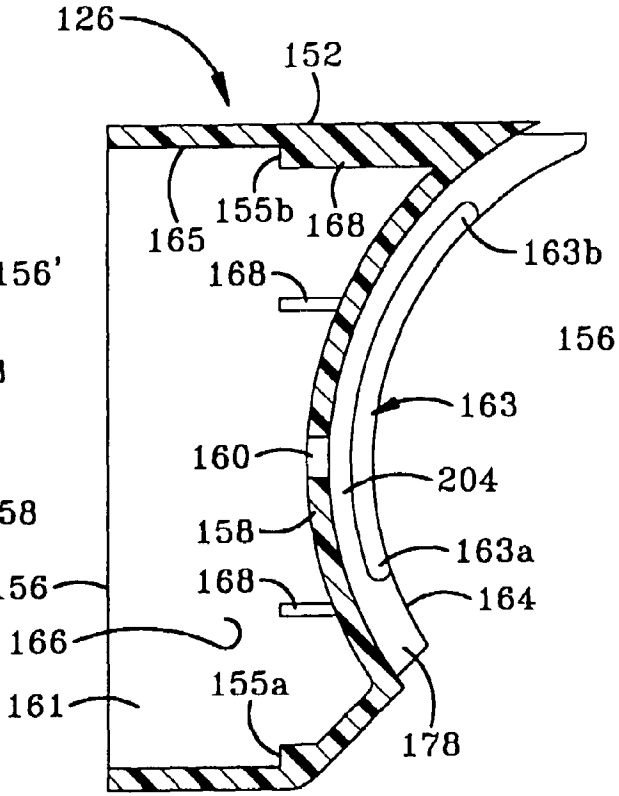
FIG. 27 is a partial side view of the rail connector of FIG. 26.
Figure 26:
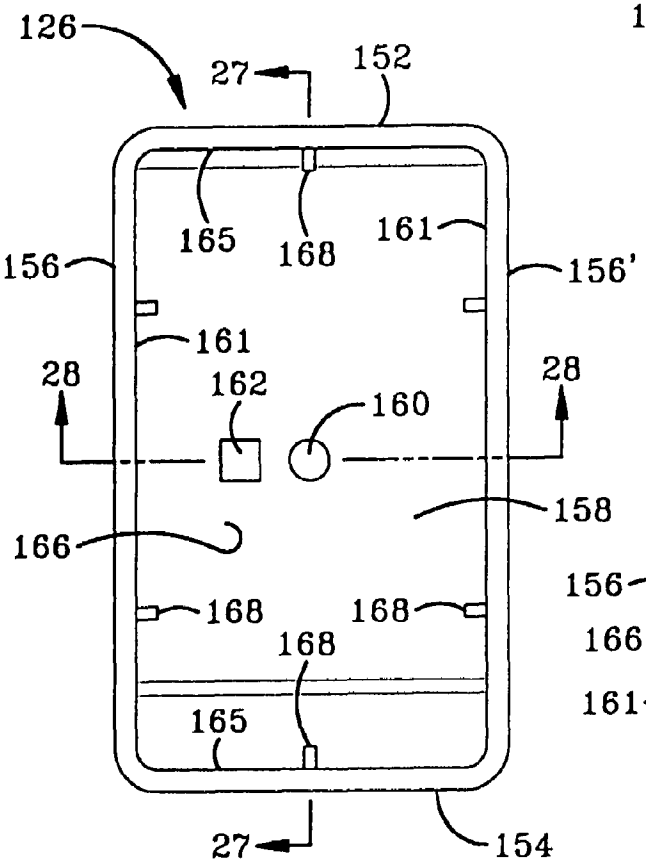
FIG. 26 is front view of the rail connector of FIG. 22.
Figure 30:
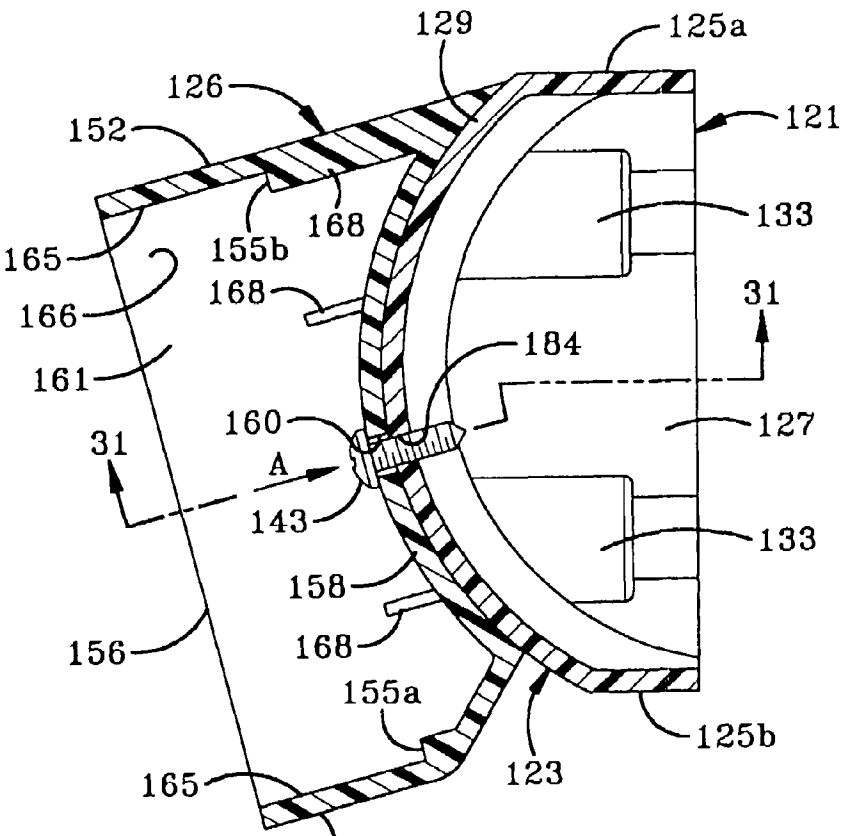
FIG. 30 is a cross-sectional side view of the rail clip of FIG. 22 showing the rail connector secured to the cover at a different angle.
Figure 29:
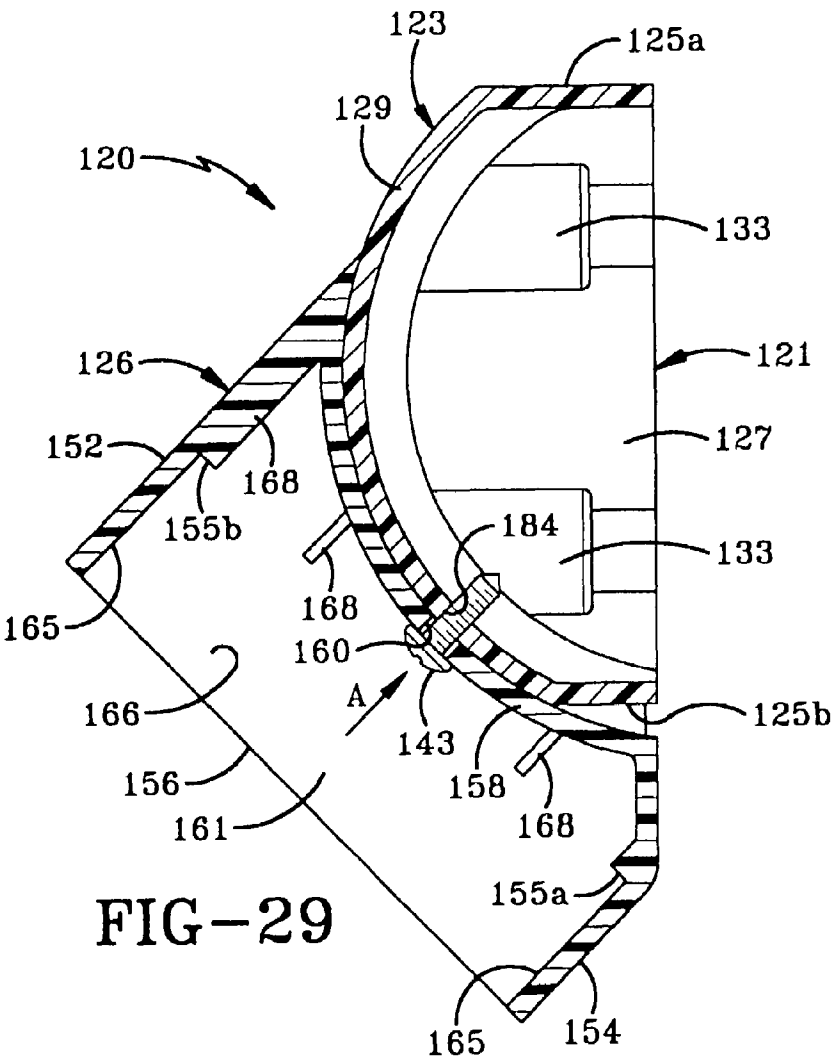
FIG. 29 is a cross-sectional side view of the rail clip of FIG. 22 showing the rail connector secured to the cover.
Figure 33:
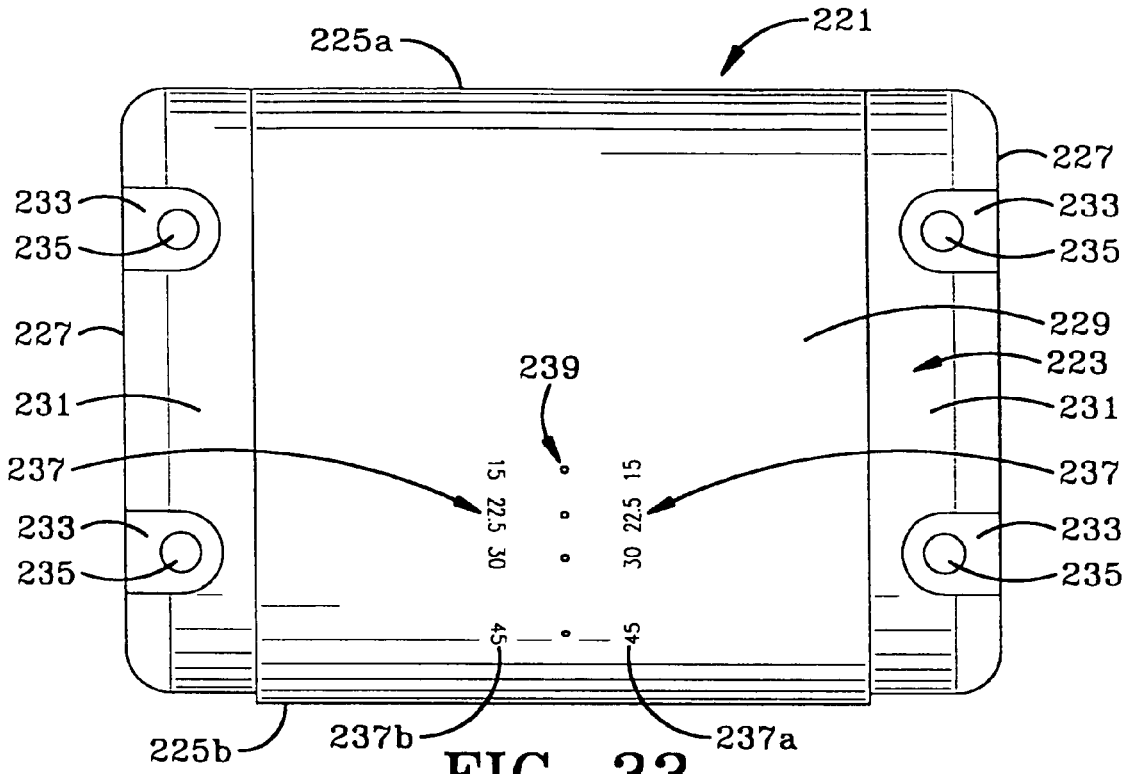
FIG. 33 is front view of the cover of the third embodiment of the rail clip.
Figure 34:
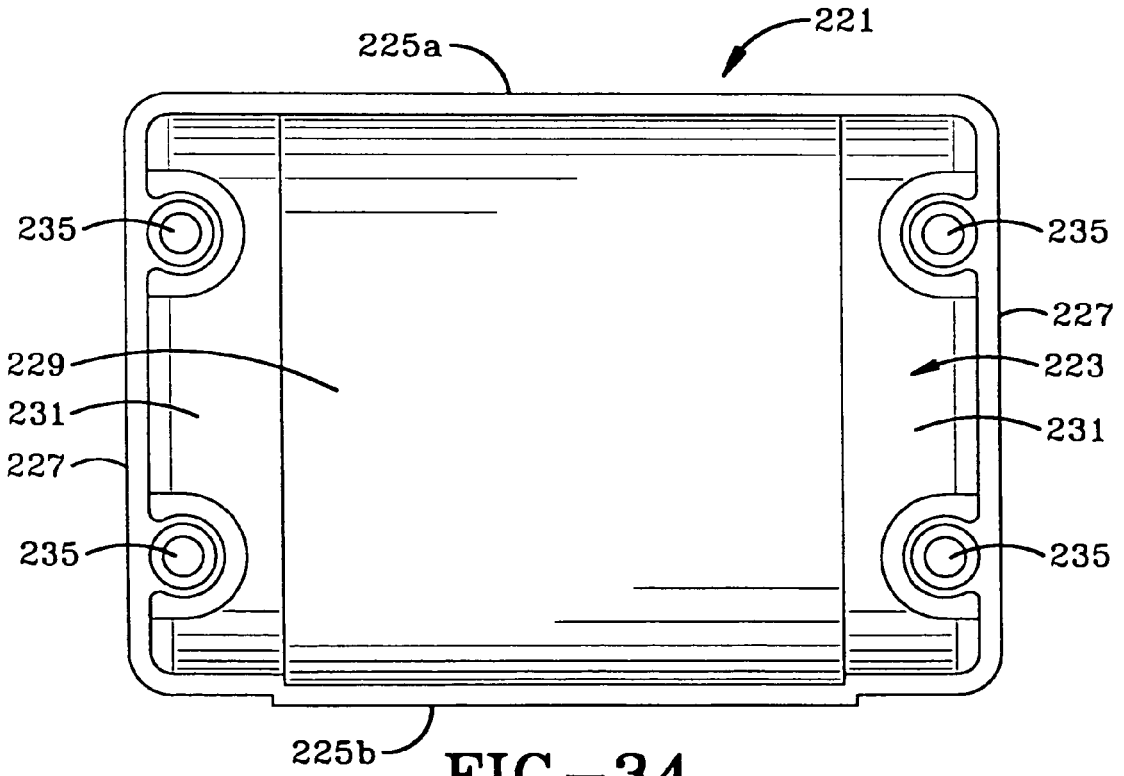
FIG. 34 is a rear view of the cover of FIG. 33.
Figure 35:
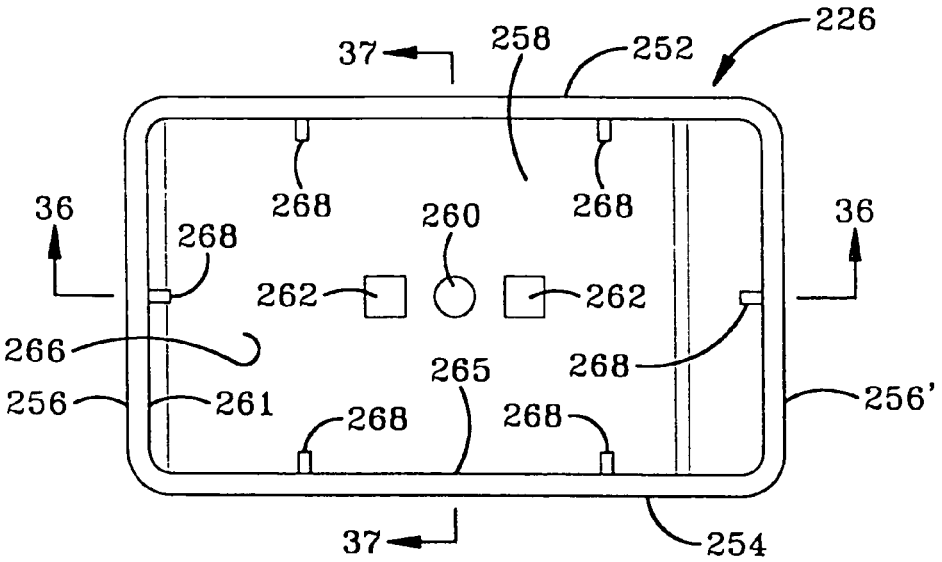
FIG. 35 a front view of the rail connector of the third embodiment of a rail clip in accordance with the present invention.
Figure 36:
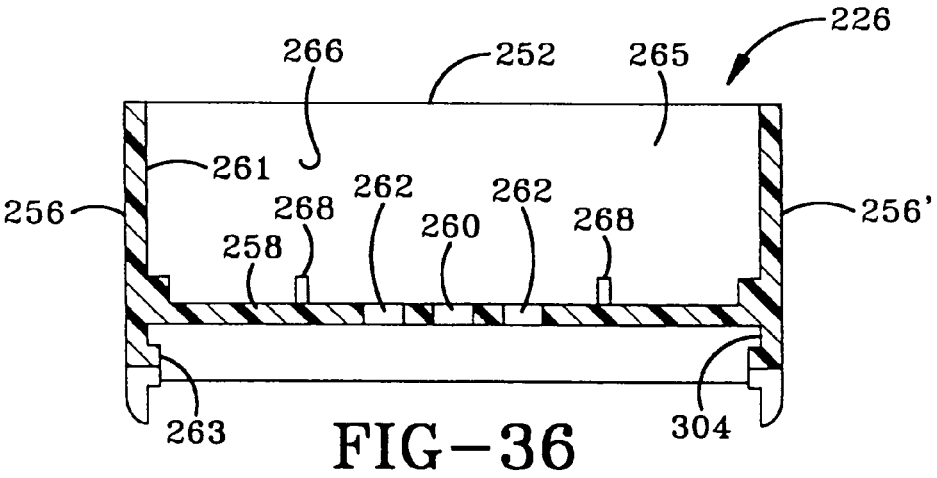
FIG. 36 is a partial cross-sectional top view of the rail connector of FIG. 35.

Referring to FIGS. 26-28, rail connector 126 may be generally rectangular in shape when viewed from the front. Rail connector 126 has an upper wall 152, lower wall 154, side walls 156, 156' and concavely curved rear wall 158. Upper wall 152, lower wall 154 and side walls 156 form a rail receiving receptacle 166 into which an end of rail 16 may be inserted. Rear wall 158 partially projects into the rail receiving receptacle 166. Rear wall 158 is complementary shaped to engage raised central area 129 of bracket 121. The back edge 164 of side walls 156, 156' may also be concave in shape. Both rear wall 158 and side walls 156, 156' are configured so that their curvature is complementary shaped to the curvature of outer wall 123 of bracket 121. Upper wall 152 may extend farther rearward than lower wall 154 as shown in FIG. 27 and lower wall 154 may include a step 155*a*. Upper wall 152 may include a step 155*b* and rail 16 is adapted to abut steps 155*a*, 155*b*. Rear wall 158 defines a hole 160 for receiving a screw 143 therethrough to secure connector 126 to bracket 121. The location of hole 160 allows the installer to view second characters 139 on outer wall 123 of bracket 121. Rear wall 158 further defines an aperture 162 through which numerical first characters 137 on outer wall 123 may be viewed.

As seen from FIG. 27, side walls 156, 156' of rail connector 126 extend a short distance beyond rear wall 158 so that a lip 178 is formed is formed between back edge 164 and rear wall 158. A ridge or boss 163 may be formed proximate back edge 164 of each side wall 156, 156'. Ridge 163 runs generally parallel to back edge 164. A second groove 204 may be formed between ridge 163 and rear wall 158. Alternatively, second groove 204 may be cut into lip 178. Ridge 163 is adapted to engage in first groove 145 of bracket 121 and to allow rail connector 126 to slide along bracket 121. Rail connector 126 is connected to bracket 121 by positioning one of upper wall 152 or lower wall 154 near to the open end 145*a* of groove 145 on bracket 121. A first end 163*a* or 163*b* of ridge 163 is inserted into open end 145*a* of groove 145. When ridge 163 engages groove 145, back edges 164 engage lateral areas 131. Bracket 121 and rail connector 126 may be moved relative to each other so that ridge 163 slides along groove 145. The sliding engagement of rail connector 126 and bracket 121 allows the user to position rail receiving receptacle 166 at any one of a range of positions along outer wall 123 of bracket 121. Side walls 156, 156' have an interior surface 161 with a plurality of tabs 168 disposed thereon. Tabs 168 may alternatively, or additionally, be positioned on interior surfaces 165 of upper and lower walls 152, 154. Tabs 168 prevent an end 96 of rail 16 from contacting rear wall 158 of rail connector 126 when it is inserted into receptacle 166.

As the position of rail connector 126 is changed by sliding it along lateral groove 145, the angle at which a rail 16 would be held relative to bracket 121 is changed. In this manner, the correct angle for attachment of rail 16 may be obtained. If the installer knows the angle at which he needs to attach rail connector 126 to bracket 121, he may simply align the appropriate first character 137 with aperture 162. When the appropriate angle is determined by the installer, a drill bit (not shown) is inserted through hole 160 so that the tip (not shown) of the drill bit engages in the appropriate dimple 139 on bracket 121. A hole 184 is then drilled into outer wall 123 of bracket 121. A screw 143 is then inserted through holes 160 and 184 in the direction of arrow A in FIG. 29 and is rotated so as to secure rail connector 126 to bracket 121. The installer may, however, drill holes 184 at any position on raised central area 129.

Rail connector 126 and bracket 121 are configured in such a manner as to allow for installation of rails 16 at a variety of angles relative to vertical post 14. As seen from FIG. 22, bracket 121 may be secured to vertical post 14 in such a manner that rail 16 may be rotated about a horizontal axis normal to post 14 or, as may be seen from FIG. 32, bracket 121 may be secured to post 14 in such a manner that rail 16 may be rotated about a vertical axis parallel to post 14. Additionally, bracket 121 may be secured to post 14 in any other orientation that will allow the installer to position rail 16 at any desired angle relative to post 14.

The size of rail 16 most commonly used in fence construction is one referred to as a 2×4. In this type of rail the width of the piece of wood or plastic is 1½ inches and its height is 3½ inches or vice versa. FIGS. 22, 23-31 illustrate a rail connector and bracket combination 126/121 that allows for rail 16 to be oriented in such a manner that the width of the rail 16 (being 2 inches) lies proximate upper and lower walls 152, 154 of rail connector 126.

A third embodiment of the invention is shown in FIGS. 33-39. In this embodiment, rail 16 may be oriented so that the width of the rail 16 is 4 inches and its height is 2 inches. As seen from FIGS. 33-39, bracket 221 is a single molded piece made from a suitable material such as plastic or vinyl. Bracket 221 is generally semicircular in shape when viewed from the side. Bracket 221 has an outer wall 223, a top wall 225*a*, a bottom wall 225*b* and side walls 227. Outer wall 223 may include a raised central area 229 and lateral areas 231. Lateral areas 231 define a plurality of slots 233 and apertures 235. Screws 236 may be inserted through apertures 235 to secure bracket 221 to a vertical post 14. As with the second embodiment, a plurality of first characters 237 may be disposed on outer wall 223 to indicate the angle at which a fence rail 16 may be held by rail clip 220. A single group or series of first characters 237*a* or 237*b* may be provided or both groups of first characters 237*a* and 237*b* may be provided. First characters 237*a* may be inverted relative to the series of characters 239 so that no matter how rail connector 226 is positioned relative to bracket 223, the installer can read off the desired angle of attachment. Outer wall 223 further includes a plurality of second characters 237 for placement of a tip of a drill bit (not shown). Second characters 237 are positioned so as to correspond with first characters 237. As with the previous embodiments, raised central area 229 defines a pair of lateral grooves 245. Grooves 245 may be open at both ends (not shown) so that rail connector 226 may be engaged with bracket 221 from either end of groove 245. Grooves 245 may be oriented either vertically or horizontally. Additionally, more than one set of first characters may be inscribed onto bracket 221 so that the installer can correctly orient rail connector 226 with respect to bracket 221 without turning rail clip 220 around.

Rail connector 226 is shown in FIGS. 35-39. Rail connector 226 is generally rectangular in shape when viewed from the front. Rail connector includes an upper wall 252, a lower wall 254, side walls 256, 256' and concavely curved rear wall 258. Upper wall 252, lower wall 254 and side walls 256 form a rail receiving receptacle 266 into which an end of rail 16 may be inserted. Rear wall 258 partially projects into the rail receiving receptacle 266. Rear wall 258 is complementary shaped to engage raised central area 229 of bracket 221. The back edge 264 of side walls 256, 256' may also be concave in shape. Both rear wall 258 and side walls 256, 256' are configured so that their curvature is complementary shaped to the curvature of outer wall 223 of bracket 221. Rear wall 258 defines a hole 260 for receiving a screw 243 therethrough to secure connector 226 to bracket 221.

The location of hole 260 allows the installer to view second characters 239 on outer wall 223 of bracket 221. Rear wall 258 further defines apertures 262 through which first characters 237 on outer wall 223 may be viewed. While this embodiment shows that a plurality of holes 260 and apertures 262 are used to view first and second characters 237, 239, one larger aperture (not shown) may be used to view both series of first characters and second characters at the same time without departing from the scope of this invention. Alternatively, at least part of rail connector 126 may be made out of a transparent material that allows the characters 137, 139 on bracket 121 to be easily seen.

Figure 37:
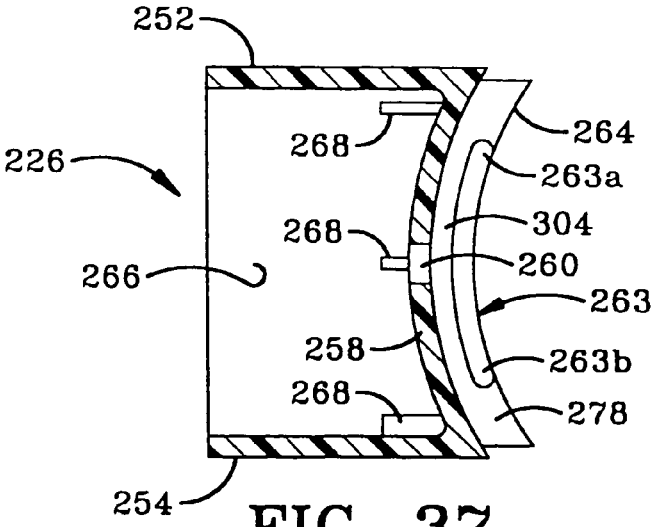
FIG. 37 is a partial cross-sectional side view of the rail connector of FIG. 35.
Figure 38:
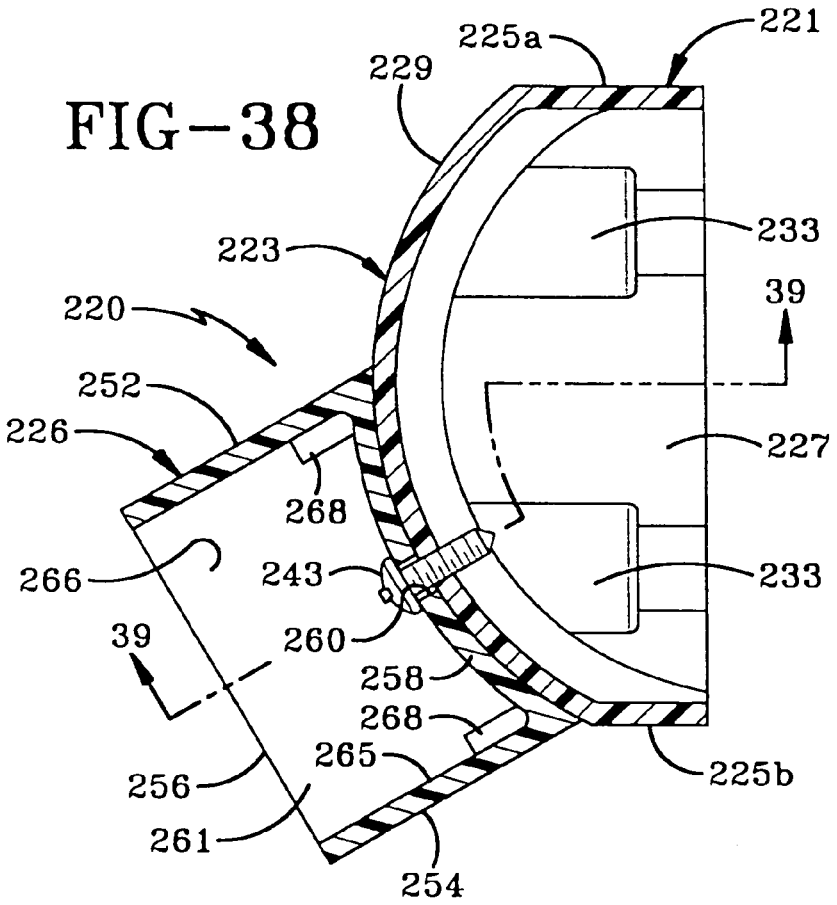
FIG. 38 is a cross-sectional side view of the third embodiment of the rail clip showing the rail connector secured to the cover.
Figure 39:
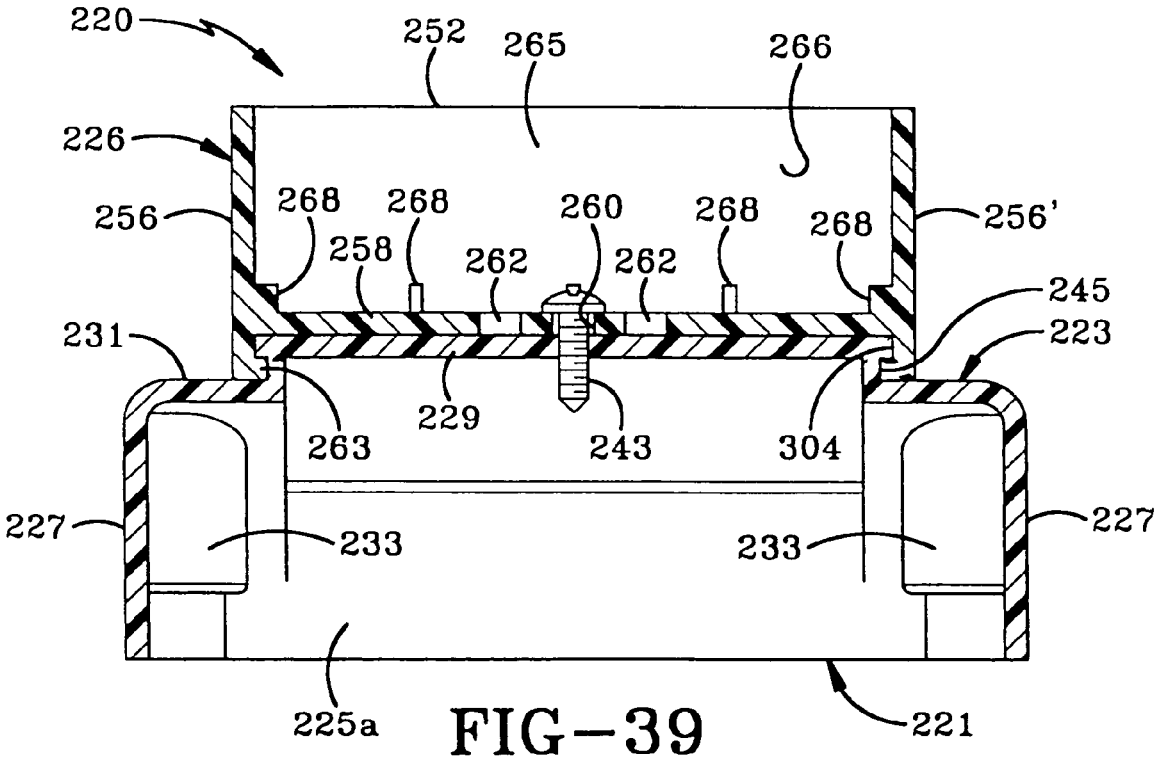
FIG. 39 is a cross-sectional top view of the third embodiment of the rail clip through line 39-39 of FIG. 38.
Figure 40:
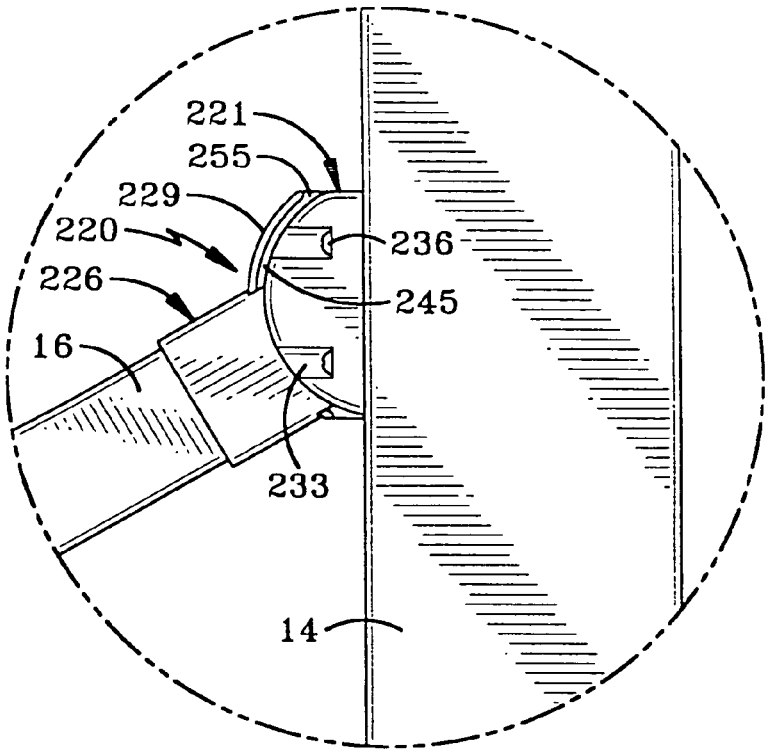
FIG. 40 is a side view of the third embodiment of the rail clip secured to a vertical post.
Figure 41:
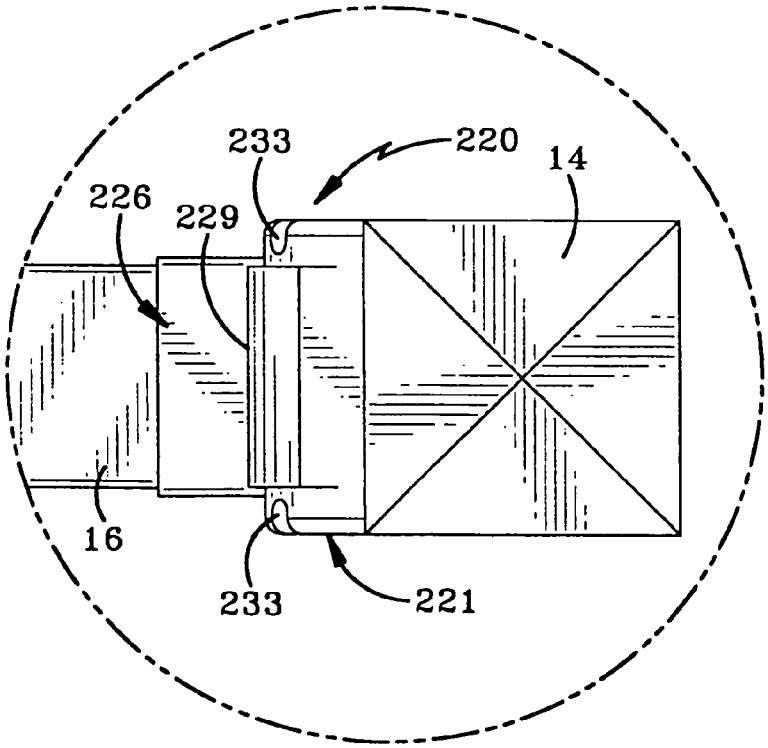
FIG. 41 is a plan view showing the third embodiment of the rail clip secured a vertical post.

As seen from FIG. 37, side walls 256, 256' of rail connector 226 extend a short distance beyond rear wall 258 so that a lip 278 is formed is formed between back edge 264 and rear wall 258. A ridge or boss 263 may be formed proximate back edge 264 of each side wall 256, 256'. Ridge 263 runs generally parallel to back edge 264. A second groove 304 may be formed between ridge 263 and rear wall 258. Alternatively, second groove 304 may be cut into lip 278. Ridge 263 is adapted to engage in first groove 245 of bracket 221 and to allow rail connector 226 to slide along bracket 221. Rail connector 226 is connected to bracket 221 by positioning one of upper wall 252 or lower wall 254 near to an open end 255 of groove 245 on bracket 221. A first or second 263*a* or 263*b* of ridge 263 is inserted into an open end 255 of groove 245. When ridge 263 engages groove 245, back edges 264 engage lateral areas 231. Bracket 221 and rail connector 226 may be moved relative to each other so that ridge 263 slides along groove 245. The sliding engagement of rail connector 226 and bracket 221 allows the user to position rail receiving receptacle 266 at any one of a range of positions along outer wall 223 of bracket 221. Side walls 256, 256' have an interior surface 261 with a plurality of tabs 268 disposed thereon. Tabs 268 may alternatively, or additionally, be positioned on interior surfaces 265 of upper and lower walls 252, 254. Tabs 268 prevent an end (not shown) of rail 16 from contacting rear wall 258 of rail connector 226 when it is inserted into receptacle 266.

There is therefore provided a method of assembling a fence rail to a pair of fence posts comprising the following steps:

a. Mounting a first adjustable rail clip 20*a* having a first rail receiving area 26*a* to a post 14*a;*
b. Mounting a second adjustable rail clip 20*b* having a second rail receiving area 26*b* to a second post 14*b;*
c. Adjusting the first and second rail clips 20*a*, 20*b* such that the first and second rail receiving areas 26*a*, 26*b* are axially aligned;
d. Placing a rail 16 in each of the first and second rail receiving areas 26*a*, 26*b* in the aligned condition during mounting of at least one of the first and second rail clips 20*a*, 20*b*.

The method of assembly may further include the step of adjusting each rail clip 20*a*, 20*b* by sliding a movable rail connector 26*a*, 26*b* over a stationary bracket 21*a*, 21*b*.

The method of assembly may further include the step of mounting a stationary bracket 21*a*, 21*b* to each of the posts 14 and adjusting a rail connector 26*a*, 26*b* relative to each bracket 21*a*, 21*b* by rotating it arcuately about a radius formed on the bracket 21*a*, 21*b*.

The second and third embodiments of the invention are used in the same manner as the first embodiment. However, installation may further include the step of adjusting the position of the rail connector 126 or 226 relative to the bracket 121 or 221 so that numerical first characters 137 or 237 are visible through holes 162 or 262. The installer may then locate the correct drilling location by placing the tip of his drill bit (not shown) in a dimple 139 or 239, drilling the required hole 160 or 260 and then using a screw to secure the rail connector and bracket together.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A rail clip for attaching a fence rail to a fence post, the rail clip comprising:

a) a bracket having a rear wall adapted to be mounted to a side wall of the fence post;
a semicircular front wall extending outwardly away from the rear wall and being disposed a radial distance away from a center point of the rear wall; and
a plurality of characters marked along the front wall of the bracket, each one of the characters representing a differently sized angle;

b) a rail connector movably engaged with the front wall of the bracket and being radially slidable therealong; said rail connector having:
an arcuate rear wall that is complementary shaped to the front wall of the bracket;
an opening formed in the rail connector and aligned along a radius of said front wall; said opening extending through the rail connector to the arcuate rear wall thereof; said opening being adapted to receive an end of the fence rail therein; and
an aperture formed in the rear wall of the rail connector and being viewable through said opening; whereby said aperture is alignable over one of the characters on said front wall of the bracket and to thereby orient the rail connector at an angle relative to the rear wall of the bracket that is represented by the one of the characters.

2. The rail clip as defined in claim 1, wherein a portion of the front wall of the bracket interlocks with a portion of the rear wall of the rail connector, thereby maintaining the bracket and rail connector in sliding engagement with each other.

3. The rail clip as defined in claim 1, further comprising at least one fastener; said fastener being insertable through the opening in the rail connector, once the aperture has been aligned over the selected character, and into both the rear wall of the rail connector and the front wall of the bracket; thereby securing the rail connector against further movement relative to the front wall of the bracket.

4. The rail clip as defined in claim 1, wherein the plurality of characters are selected from a group consisting of numbers, colors, words, symbols and dimples.

5. A rail clip for attaching a fence rail to a fence post, the rail clip comprising:

a) a bracket having a rear wall adapted to be mounted to a side wall of the fence post;
a semicircular front wall extending outwardly away from the rear wall and being disposed a radial distance away from a center point of the rear wall;

b) a rail connector movably engaged with the front wall of the bracket and being radially slidable therealong; said rail connector having:

an arcuate rear wall that is complementary shaped to the front wall of the bracket;

an opening formed in the rail connector and aligned along a radius of said front wall; said opening extending through the rail connector to the arcuate rear wall thereof; said opening being adapted to receive an end of the fence rail therein;

an aperture formed in the rear wall of the rail connector and being viewable through said opening;

c) a series of first characters marked on the front wall, each first character representing a variety of angles at which the rail connector may be held relative to the rear wall of the bracket; and d) a series of second characters marked on the front wall; each second character being associated with one of the first characters, and each second character comprising a dimple that is adapted to represent a position at which to insert a fastener to secure the rail connector to the front wall of the bracket; whereby said rail connector is radially slidable along the front wall of the bracket to align the aperture over a pair of a selected one of the first characters and its associated second character; and to thereby orient the rail connector at a desired angle relative to the rear wall of the bracket that is represented by the selected one of the first characters; and further to indicate a position for the insertion of a fastener by the selected one of the second characters so as to enable securement of the rail connector at the desired angle relative to the rear wall of the bracket.

6. The rail clip as defined in claim 5, wherein a portion of the front wall of the bracket interlocks with a portion of the rear wall of the rail connector, thereby maintaining the bracket and rail connector in sliding engagement with each other.

7. The rail clip as defined in claim 5, further comprising at least one fastener; said fastener being insertable through the opening in the rail connector, once the aperture has been aligned over the selected character, and into both the rear wall of the rail connector and the front wall of the bracket; thereby securing the rail connector against further movement relative to the front wall of the bracket.

8. The rail clip as defined in claim 5, wherein the plurality of first characters is selected from a group consisting of numbers, colors, words, symbols and dimples.

* * * * *